US005633699A

United States Patent [19]

Aruga et al.

[11] Patent Number: 5,633,699

[45] Date of Patent: May 27, 1997

[54] STRUCTURE FOR MOUNTING A ROTARY MEMBER AND IMAGE FORMING APPARATUS USING SAME STRUCTURE

[75] Inventors: Tomoe Aruga; Yasuhito Hirashima; Akihiko Ikegami; Yoshiro Koga, all of Nagano, Japan

[73] Assignee: Seiko Epson Corporation, Tokyo, Japan

[21] Appl. No.: 324,553

[22] Filed: Oct. 18, 1994

[30] Foreign Application Priority Data

Oct. 19, 1993 [JP] Japan ..... 5-261255
Sep. 30, 1994 [JP] Japan ..... 6-261674

[51] Int. Cl.[6] ..... G03G 15/00; G03G 21/00

[52] U.S. Cl. ..... 399/107

[58] Field of Search ..... 355/200, 210, 355/245

[56] References Cited

U.S. PATENT DOCUMENTS 5,398,097 3/1995 Satoh et al. ..... 355/200
5,406,355 4/1995 Komuro et al. ..... 355/210
5,475,469 12/1995 Okada et al. ..... 355/245 X

*Primary Examiner*—Fred L. Braun
*Attorney, Agent, or Firm*—Stroock & Stroock & Lavan

[57] ABSTRACT

A structure for mounting a rotary member is provided including employing a pair of opposed spaced sheet members. First and second supporting structures are respectively formed at opposed locations on the sheet members, the supporting structures each being one of a projecting part and a barring part. The rotary member is formed with one of an axial shaft or an axial bore on each side thereof for engagement with and support by a corresponding opposed pair of supporting structures. The support structures may be either projecting parts, or barring parts. An image forming apparatus is also provided employing this improved structure for mounting a rotary member. The support structures are formed on frame portions of the image forming apparatus.

42 Claims, 14 Drawing Sheets

II
III
U2
49
H#
V#
F#
C#
101(102)
A#
B#
103
II
III

STRUCTURE FOR MOUNTING A ROTARY MEMBER AND IMAGE FORMING APPARATUS USING SAME STRUCTURE

BACKGROUND OF THE INVENTION

The present invention relates generally to a structure for mounting a gear, a roller, or another rotary member and more particularly to an image forming apparatus, such as a printer or a facsimile machine, which performs a process for forming an image on a sheet material and employs this improved structure for mounting a gear, a roller, or another rotary member.

A typical example of an image forming apparatus based on the prior art is disclosed in Japanese Patent Application Laid Open No. 222270-1989 (Heisei 1). The mounting structure for a gear in the motive power transmitting mechanism for this apparatus is shown in FIG. 15, and is a structure formed with a first supporting shaft 502, which supports a gear 501, being fixed in a frame 503, or formed with a gear mounted on each of both the ends of a second supporting shaft 505 inserted into a shaft bearing 504.

An additional example of a prior art mounting structure, as shown in FIG. 16, 17 and 18, including a structure for mounting a component part by an application of a burring shaping process, is found in the structure disclosed in Japanese Patent Application Laid Open No. 34531-1989 (Showa 64). This structure is formed by forming a burring part 511 on a metal plate 510, mounting a rotary member or a sliding member 512 on this burring part 511, as shown in FIG. 16, and then bending a top end 513 of burring part 511 as shown in FIGS. 17 and 18, thereby preventing the rotary member or sliding member 513 from falling off. However, these structures have a number of significant limitations.

The environment surrounding computers in the more recent years is marked by a progressive downsizing of the size of computers, compact notebook type computers rising to a position of far greater importance than ever before. Along with this tendency, the market for personal computers has been enlarged to such an extent that there are now more intensified demands for the appearance of more compact external peripheral equipment, such as printers and facsimile machines. These peripherals must be offered for sale at lower prices, and must be smaller for use with compact-sized computers. Together, these components must be capable of being arranged on an individual person's desk leaving free work space still available. The prior art mentioned above cannot respond to such demand.

The structure for mounting a gear as disclosed in Japanese Patent Application Laid Open No. 222270-1989 (Heisei 1), described above, is formed of a large number of component parts and is complicated, so that it is difficult to achieve a reduction in the size of this apparatus or to realize a reduction in its cost. On the other hand, the structure disclosed in Japanese Patent Application Laid Open No. 34531-1989 (Show 64) is formed of a fewer number of component parts and has a relatively simple structure, so that it is considered to be relatively easy to achieve a reduction in the size of the apparatus and to achieve a reduction in its cost. Yet, this structure requires a processing operation for bending the top end portion 513 of the burring part. If this bending process is not performed with high accuracy, a gap w formed during the bending of each part, shown in FIG. 17, will not be uniform for all parts. Thus, it will not always be possible to attain stability during rotation of the rotary member or sliding member 512. Either the part will be too loose, which will result in vibrations during rotation, or the part will be too tight, which will result in a loss of torque due to friction.

Accordingly, it would be advantageous to provide a structure for mounting a rotary member which achieves a reduction in size of the apparatus and a reduction in its cost, which attains stability during rotation of the rotary member, and which offers an image forming apparatus using this improved structure for mounting a rotary member.

SUMMARY OF THE INVENTION

Generally speaking, in accordance with the present invention, at least two sheet metal members are provided in spaced positions opposed to each other. Support members formed as barring parts or projecting parts respectively are formed in opposite positions on these sheet metal members. A rotary member is arranged between the above-defined sheet metal members forming one pair of support members. Each side of the rotary member either has a shaft supported by a burring part or a hole supported by a projecting part which permit the rotary member to rotate. Hence, the rotary member will have both ends of a shaft portion thereof supported by a pair of opposed burring parts, or have a hole portion supported by a pair of opposed projecting parts, or have one end of a shaft portion thereof supported by a burring part while having a hole portion at the other end of the part supported by a projecting part. The projecting parts may be formed with a round contour at the top portion, and the inside surfaces of the burring parts or outer surface of the projecting parts may be polished to a mirror-smooth finish.

Furthermore, an image forming apparatus in accordance with the present invention has an image forming unit with a photosensitive drum and an exposing unit for forming and developing a latent image on the photosensitive drum. The image forming apparatus also has a frame in which these individual units are to be mounted and a driving unit having at least a driving gear for driving and rotating the photosensitive drum defined above. The above described rotary member mounting structure is employed in the image forming apparatus.

Thus, the present invention renders it unnecessary to form an additional support shaft, to fix such a support shaft or insert such a shaft into a shaft bearing, or to bend the top portion of the burring as required by the prior art in order to mount and support a rotary member. Therefore, an apparatus in which the structure according to the present invention is used can achieve a reduction in size and a reduction in cost, and achieve increased stability in its performance.

Further, the pair of opposed supporting members, each either a burring part or a projecting part which is formed directly in a sheet metal member, supports the rotary member at both its ends. This structure has increased strength and can resist a larger axial force (motive power) in comparison with a structure formed with a support shaft fixed in the frame.

If the structure for mounting a rotary member is formed with a round contour formed at the top portion of the projecting part, it will be easier to insert the projecting part into a hole made in an end portion of the rotary member. This feature improves efficiency in the assembly of the structure and does not cause any damage to the rotary member.

If the structure for mounting a rotary member is formed with the inside surfaces of the burring parts or the outside surfaces of the projecting parts polished to a mirror-smooth finish, the rotary member will have less sliding friction and a reduction in torque loss, and an improvement in durability of the part will be achieved.

Such a structure for mounting rotary members will prove most effective when a large number of rotary members are used in a structure. There will be a plurality of burring parts or projecting parts formed, and a plurality of rotary members supported between, the sheet metal members. In this case, it will be possible to assemble the structure for mounting a rotary member merely by setting one sheet metal member on its side so that the plurality of projecting parts face upward. Then one would set the proper rotary member on each projecting part or burring part. Finally, the other sheet metal member would be placed over the projecting parts of the former sheet metal member. Thus, each rotary member will be supported from each sheet metal member. Since an image forming apparatus in general has a plurality of driven parts, its driving force transmitting unit has a large number of rotary members. Therefore, it will be particularly effective to employ the above-mentioned structure for mounting a rotary member in an image forming apparatus.

With the image forming apparatus of the present invention, wherein the driving unit is formed using the structure for mounting a rotary member stated above, it is made possible to achieve a reduction in size of the apparatus and to achieve a reduction in cost. Since the driving unit defined above can be constructed so that at least one of the pairs of the sheet metal members forms a portion of the frame of the apparatus, the image forming apparatus can attain a further reduction in size and a further reduction in cost.

The positioning accuracy for an image forming unit, in which an exposing unit forms a latent image on photosensitive drum by exposing the photosensitive drum to light, is important in order to improve the quality of images. Also, the positioning accuracy between the photosensitive drum and the driving gear or driving unit, which rotates to drive this photosensitive drum, is important to improve the quality of images by rotating the photosensitive drum smoothly without any vibration and thus reducing any irregularity in rotation. To improve this positioning accuracy, one portion of the frame on which the image forming unit and the exposing unit are mounted may be formed by one of the pair of sheet metal members of the driving unit. In addition, the positioning unit for the image forming unit is mounted on the frame of the driving unit. Thus, it is possible to maintain the positioning accuracy among these three units so that the image forming apparatus can produce high quality images. In addition, the sheet metal members used in the frame form a means for shielding the electro-magnetic noises generated in the inside region of the image forming apparatus.

Accordingly, it is an object of the present invention to provide an improved structure for mounting a gear, a roller, or another rotary member.

Another object of the present invention is to provide an improved structure for mounting a rotary member in which supporting members comprising burring parts or projecting parts are formed in opposing sheet metal members, and the rotary member is mounted between the supporting members.

A further object of the present invention is to provide an improved structure for mounting a rotary member where the projecting parts are formed with a round contour to reduce wear in the parts, and improve ease in assembly.

A still further object of the present invention is to provide an improved structure for mounting a rotary member which reduces friction between the part and the mounting structure.

Yet another object of the present invention is to provide an image forming apparatus employing the above-referenced method for mounting a rotary member.

A still further object of the present invention is to provide an image forming apparatus whereby the above-mentioned structure for mounting a rotary member is used which reduces the size, and improves the accuracy of the recording apparatus.

Still other objects and advantages of the invention will in part be obvious and will in part be apparent from the specification and drawings.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8(*a*) is a cross-sectional view of a portion of the force transmitting unit according to the invention taken along a line drawn through the rotational axis of the gears depicted; FIG. 8(*b*) and FIG. 8(*c*) are fragmentary cross-sectional views taken along line A—A of FIG. 8(*a*), FIGS. 8(*b*) and 8(*c*) being the same parts viewed at different modes of engagement;

FIG. 9(*a*) is a cross-sectional side elevational view of a portion of the force transmitting unit according to the invention taken along a line drawn through the rotational axis of the gears depicted; FIGS. 9(*b*) and 9(*c*) are partial side elevational views of elements of FIG. 9(*a*);

FIG. 10(*a*) is a cross-sectional view of a portion of the force transmitting unit according to the invention; FIG. 10(*b*) and FIG. 10(*c*) are cross-sectional views taken along line B—B of FIG. 10(*a*), FIGS. 10(*b*) and 10(*c*) being the same parts viewed at different modes of engagement;

DETAILED DESCRIPTION OF THE PREFERRED EMBODIMENTS

Figure 1:
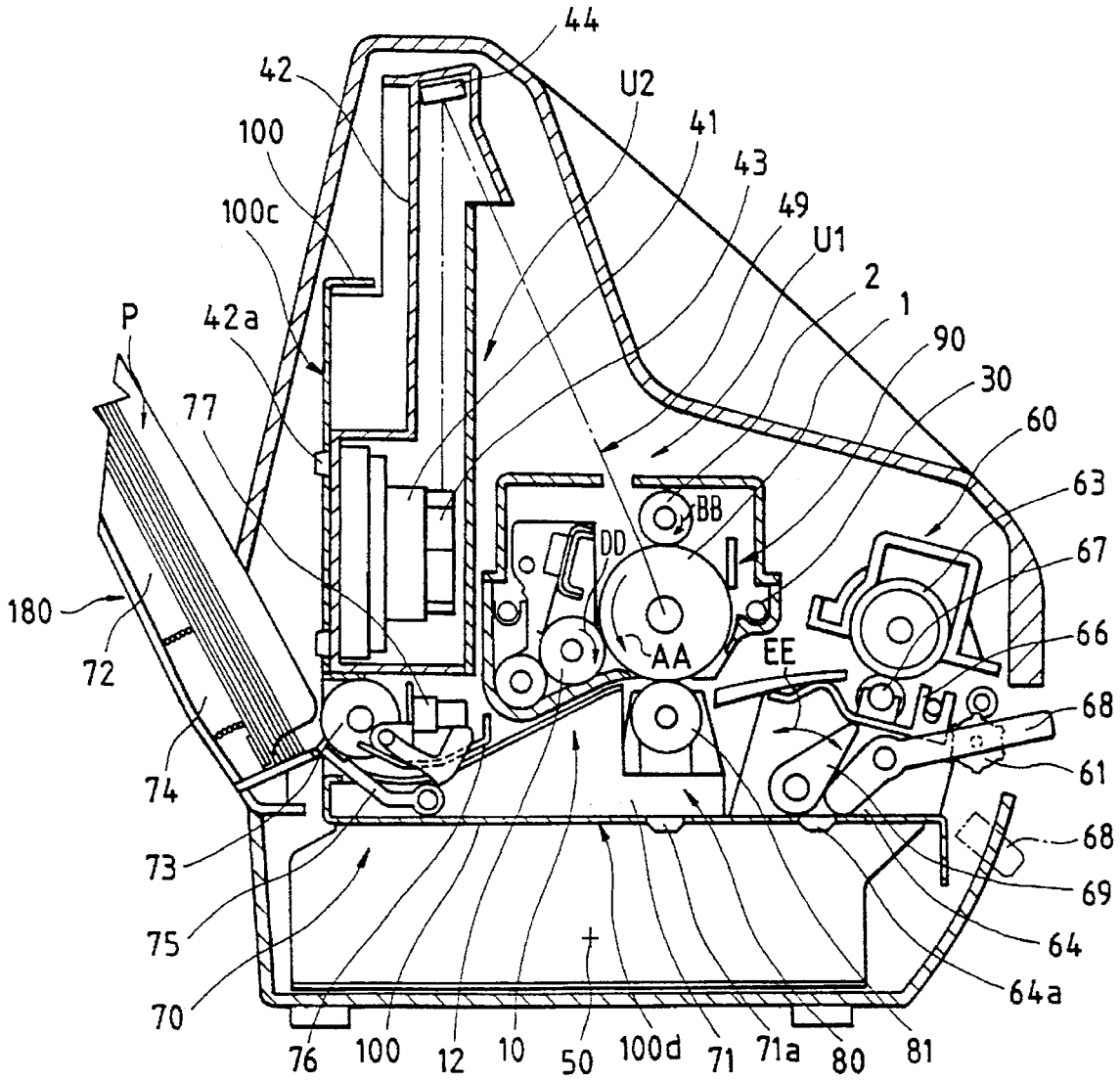
FIG. 1 is a side elevational view of an image forming apparatus in a preferred embodiment of the present invention.

Referring first to FIG. 1, an image forming apparatus, indicated generally as 180, consists of an image forming unit U1, which is arranged approximately in a central area of image forming apparatus 180. Image forming unit U1 is further composed of a photosensitive drum 1, a charging roller 2, a cleaner unit 90, a developing unit 10, and a toner transport unit 30.

Figure 4:
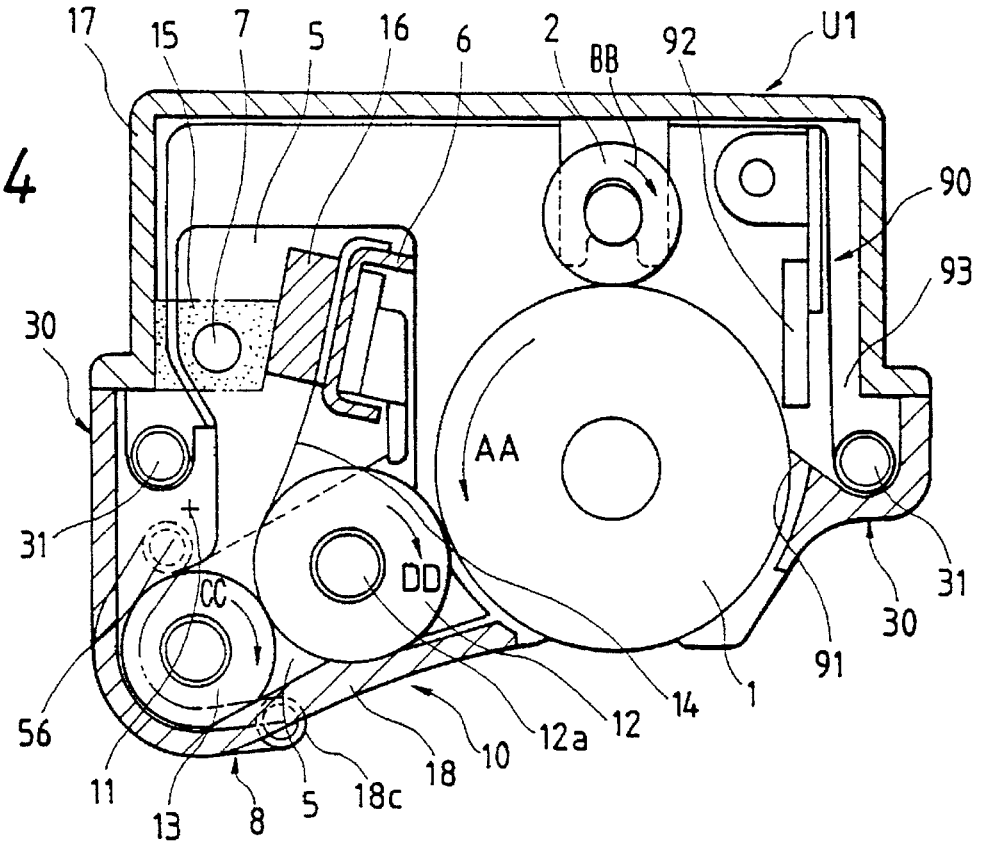
FIG. 4 is an enlarged cross-sectional view of the image forming unit of the preferred embodiment taken along the line IV—IV of FIG. 2.
Figure 5:
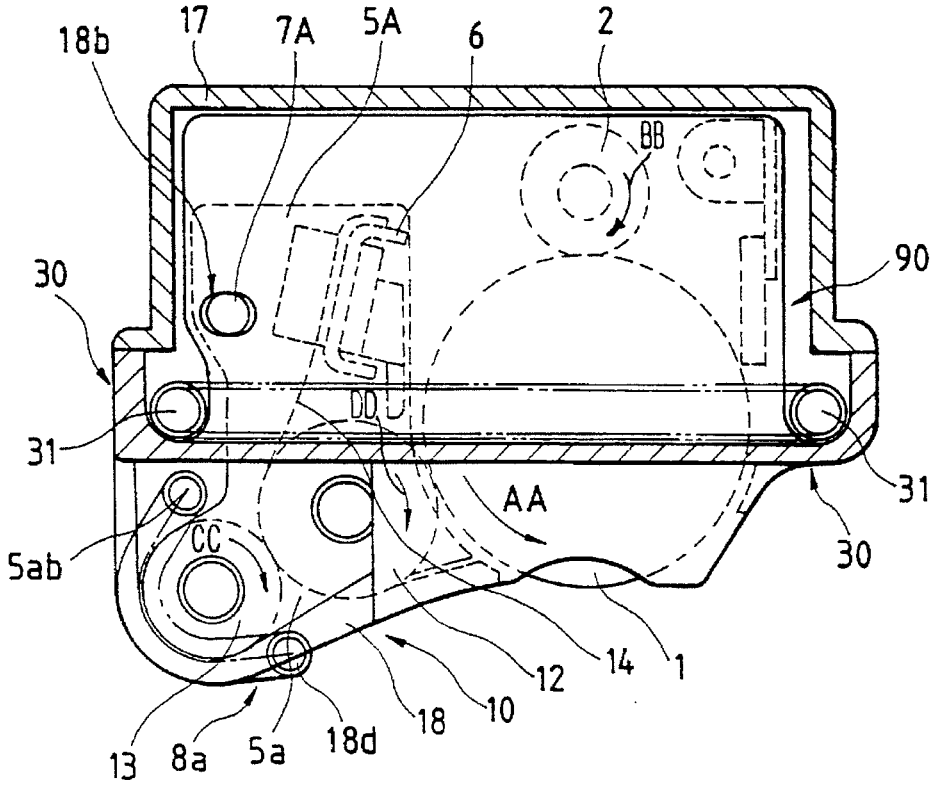
FIG. 5 is a partially cut-away side elevational view of the other side of the image forming unit of the preferred embodiment shown in FIG. 4.

Referring to FIG. 4, in this preferred embodiment charging roller 2 is formed of a semi-conductive elastic material such as rubber. Charging roller 2 is in rolling contact with photosensitive drum 1, which rotates in the direction indicated by Arrow AA. Therefore, charging roller 2 is rotated in the direction indicated by Arrow BB. In this preferred embodiment, a DC voltage of about −2 kV is applied to charging roller 2, and photosensitive drum 1 is charged to an electric potential in the range from −600 V to −700 V. Charging roller 2 is retained in rolling contact with photosensitive drum 1 by a pressing mechanism (not shown), under a total force of approximately 1 kg.

During operation, as shown in FIG. 1, a latent image is formed on photosensitive drum 1, by exposure to a light beam 49 emanating from an exposing unit U2. The electric potential exposed by an image exposing unit U2 will be in the range from −50 V to −150 V.

As shown in FIG. 4, developing unit 10 is provided with a toner storage unit 11, which stores toner which may be charged with the same polarity as photosensitive drum 1. In addition, a feeding roller 13 and a developing roller 12 are provided. Feeding roller 13 is formed of a semi-conductive elastic material such as a foamed rubber material and rotates in the direction indicated by Arrow CC in FIG. 4 so that the toner stored in toner storage unit 11 will be coated on the surface of feeding roller 13. Feeding roller 13 is maintained in sliding friction contact with developing roller 12, which is formed of a semi-conductive elastic material such as a rubber material, and rotates in the direction indicated by Arrow DD in FIG. 4. This contact between developing roller 12 and feeding roller 13, frictionally charges the toner with a negative charge and coats the surface of developing roller 12 with toner.

The surface of developing roller 12 is coated with a thin layer of toner of a thickness of approximately 10 μm. This thickness is maintained by sliding friction contact between developing roller 12 and regulating blade 14. Regulating blade 14, which is made of an elastic material, for example a stainless steel plate, is kept in direct contact with almost the entire axial length of a portion of the outer circumferential surface of developing roller 12 in the axial direction under a total force of approximately 1 Kg. In addition to regulating the thickness of the coated layer of toner, this sliding friction with regulating blade 14, frictionally charges the toner to a uniform negative charge.

Developing roller 12 has a DC bias voltage applied to it in a range of approximately −200 V to −400 V. The thin toner layer coating on developing roller 12 is transported to photosensitive drum 1 and the toner is developed onto the exposed portion of photosensitive drum 1 in the nip area formed by developing roller 12 and photosensitive drum 1 as they come into rolling contact under pressure.

The toner held in toner storage unit 11 is stored in a prescribed narrow space which is partitioned off and sealed by means of a seal 15. Seal 15 may be formed, for example, of a foamed rubber material, for example. Elastic seal 15 seals an area surrounding toner storage unit 11 formed of a unit upper case 17, a unit lower case 18, regulating blade 14, a pressing member 16 for regulating blade 14, developing roller 12 and feeding roller 13, as illustrated in detail in FIG. 4.

The toner developed onto the exposed portion of photosensitive drum 1 is then transferred by image transfer unit 80 which will be described in detail below. The toner remaining on photosensitive drum 1, after transfer of the image from photosensitive drum 1, rotates past a scooping sheet 91, which is formed, for example, of a Mylar sheet. The toner is then scraped off of photosensitive drum 1 by a cleaning blade 92, which is kept in contact under pressure with photosensitive drum 1. The toner thus collected is stored in a prescribed space 93 formed by scooping sheet 91 and cleaning blade 92.

After being scraped clean, photosensitive drum 1 is ready to process the next image. After the cleaning process, the electric potential remaining on photosensitive drum 1 is removed, by light irradiation or the like. Thus, the electric potential on the surface of photosensitive drum 1 returns to the proper state for the initial phase of the image forming process.

The manner of processing toner will now be described. The prior art image forming apparatus has a toner cartridge which contains enough toner to supply toner to the required parts for the operating life of the above-mentioned principal component parts. Since the prior art image forming apparatus does not work efficiently in the replacement and maintenance of the toner or toner cartridge, in order to hold all of this toner the image forming apparatus of the prior art must be a large and expensive apparatus.

In contrast, the image forming apparatus which is described in this preferred embodiment is formed differently from the construction of any prior art image forming apparatus.

First, only a minimum amount of toner is stored in toner storage unit 11. This minimal amount of stored toner does not impede the image forming process described above, and the space of the toner storage unit 11 is reduced accordingly. The image forming apparatus is constructed so that as toner is depleted during the developing process as described above, toner is replenished by a gravity feeding system from toner transport unit 30, which transports toner in the space of toner storage unit 11 in the manner described below.

Toner which has been scraped off of photosensitive drum 1 by cleaning blade 92 is stored in the prescribed space 93 formed of scooping sheet 91 and cleaning blade 92. This toner will be transported by toner transport unit 30 when the quantity of toner in prescribed space 93 increases above a predetermined level.

Figure 12:
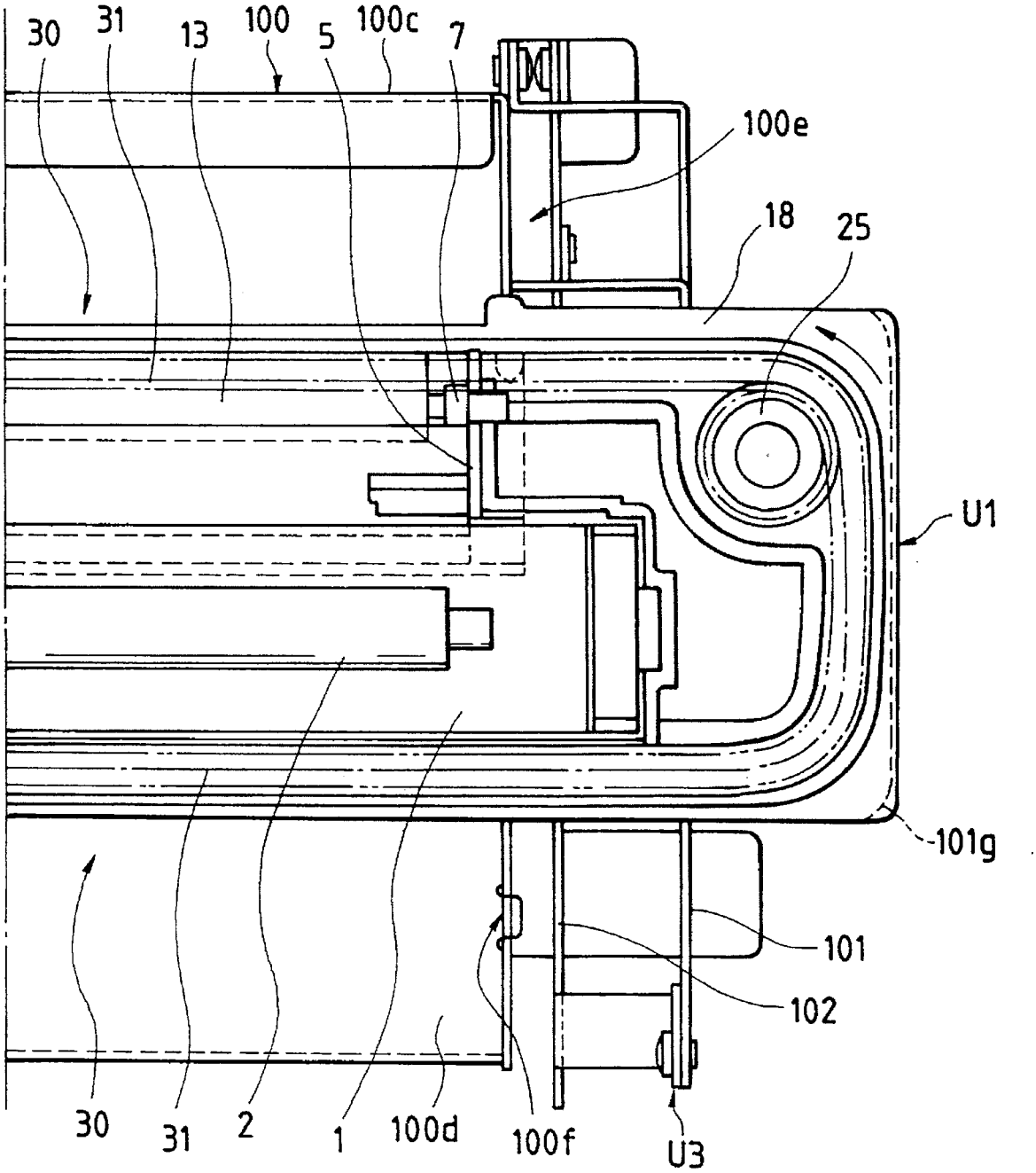
FIG. 12 is a fragmentary partially sectioned top plan view of the upper portion of the image forming unit of the preferred embodiment of the present invention.

Toner transport unit 30 is arranged in an approximately horizontal position in a track shape with photosensitive drum 1 positioned approximately in the center thereof, as shown in FIG. 12. Toner transport unit 30 is provided with a toner transport means including an endless coil spring 31 continuously advanced by driving means 25. The toner is circulated and transported by using endless coil spring 31. Endless coil spring 31 is formed in an endless construction, though not visible in FIG. 12 since only half the unit is illustrated. The other half of the unit is symmetrical to that shown.

Next, the process for circulation of the toner will be described. Approximately 10% to 30% of the toner which is not transformed in the image transfer process is collected in prescribed area 93, after being scraped off of photosensitive drum 1 by cleaning blade 92, after the transfer of the image, and is transported to toner transport unit 30. This is the reclaimed toner. Even though the image forming apparatus according to the present invention is constructed so as to reclaim toner as described above, toner will be consumed in the image forming and developing process.

In order to replenish the new toner, the image forming apparatus in this embodiment is constructed with toner replenishing means, which feeds toner by a self-weight feeding process to toner transport unit 30 for circulation as described in detail below. Toner transport unit 30 transports, circulates and mixes the replenished toner together with the reclaimed toner mentioned above, and returns these two types of toner by a gravity feeding system from toner transport unit 30 to toner storage unit 11 (as the mixed toner reaches toner storage unit 11 along the path of endless coil spring 31).

Reference is made to FIG. 2, FIG. 4, FIG. 5 and FIG. 12, wherein the nip part which is formed between developing roller 12 and the photosensitive drum 1 is described.

Figure 2:
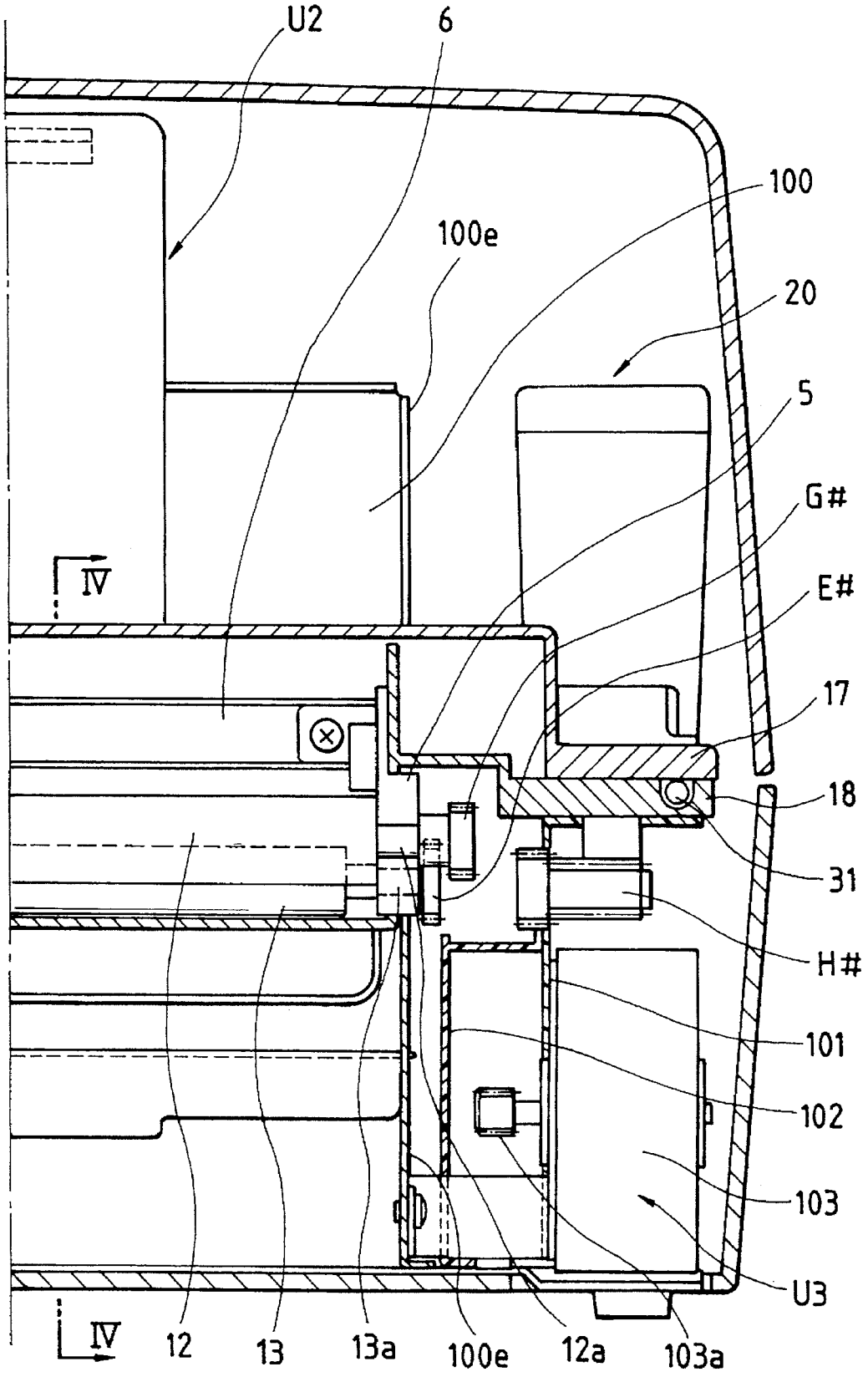
FIG. 2 is a partial, enlarged cross-sectional view of the image forming apparatus as taken along the line II—II shown in FIG. 6.

Feeding roller 13, which is formed of a semi-conductive elastic material such as a foamed rubber material, and developing roller 12, which is formed of a semi-conductive elastic material such as a rubber material, each have a rigid body portion made of metal as their respective cores and are respectively provided with developing roller supporting member 12*a* and feeding roller supporting member 13*a* which each extend from both end portions of the respective elastic material. These supporting parts 12*a* and 13*a* are in turn supported by a supporting member 5, so that supporting members 12*a* and 13*a* may rotate freely, as shown in FIG. 2. Feeding roller 13 and developing roller 12 are shown in FIG. 2 being supported on their right side. The left side of the structure is symmetrical to that shown in FIG. 2 and includes a second supporting member 5 (not shown).

Feeding roller 13 and developing roller 12 are supported at a position at which the two rollers exert pressure upon each other. The outer circumferences of both the rollers are formed so as to be in contact over an entire region in the longitudinal direction. The relation between the position of feeding roller 13 and that of developing roller 12 is illustrated in detail in FIG. 4 and in FIG. 5.

Feeding roller 13 and developing roller 12 are constructed to rotate in the directions indicated by Arrows CC and DD, respectively, and to be in sliding friction contact with each other. If the force holding rollers 13 and 12 together is increased, the necessary driving torque for their rotation will be increased. Thus, toner which is subjected to sliding friction in the nip portion between the rollers of both these parts will suffer a serious deterioration in quality. In order to allow for discrepancies among the component parts in relation to their supporting structure, in a preferred embodiment, these component parts are supported at a fixed pitch narrower by 0.25 mm than the point at which the outer circumferences of feeding roller 13 and developing roller 12 come into contact.

Supporting members 5 (FIG. 4) and 5A (FIG. 5) which rotatably support both the ends of feeding roller 13 and developing roller 12, respectively, are formed into a unified structure, each supporting member being firmly connected with the other by fixing means such as screws via a connecting member 6. As shown in FIG. 12, supporting member 5 is able to rotate freely while being supported by a supporting pin 7, which is fixed to supporting member 5 and inserted into unit lower case 18. The same supporting structure is employed also at the other side of image forming unit U1, which is symmetrical to FIG. 12.

Supporting member 5, feeding roller 13, and developing roller 12 are all connected by connecting member 6, and along with regulating blade 14, can rotate as a unified structure in relation to photosensitive drum 1 in the space of toner storage unit 11, using supporting pin 7 as the pivot.

In order for feeding roller 13 and developing roller 12 to easily rotate, unit lower case 18 is provided with a gap between it and supporting member 5. Thus, unit lower case 18 will be free from supporting member 5 in the rotating direction. This gap is covered with a sealing member having elasticity, (not shown) which prevents toner from leaking.

In order to ensure that developing roller 12 and photosensitive drum 1 are kept in mutual contact under pressure thereby forming a stable nip portion, hook parts 5*b*, 5*ab*, 18*c*, 18*d* (FIGS. 4 and 5) are formed on both supporting members 5, 5*a* and on both ends of unit lower case 18 for receiving springs 8 (FIG. 4) and 8A (FIG. 5) are provided for applying a tensile force to supporting members 5 and 5A, respectively so as to urge developing roller 12 in the direction of photosensitive drum 1.

Supporting pin 7 is supported to allow proper rotation even if the left and right supporting positions thereof do not correspond precisely. The socket for receiving one supporting pin 7 in unit lower case 18 and the receiving portion of supporting members through which supporting pin 7 is inserted, on one side of the unit, are formed in a round shape identical to the shape of the supporting pin 7 (FIG. 4). However, the socket for receiving the other supporting pin 7 in unit lower case 18 and the receiving portion of supporting members through which the other supporting pin 7 is inserted, in the other side of the unit, are formed into an oblong opening 18b in which the other supporting pin 7 may move freely to remain in contact with or separate from photosensitive drum 1 as necessary. Thus, supporting pin 7 may be moved in its position slightly during operation. This ability prevents any impediment or misalignment from upsetting the rotation of the component parts in that all of the component parts can move slightly to properly interact with other parts in image forming apparatus 180.

In this preferred embodiment, oblong opening 18*b* is formed in unit lower case 18. It is also possible to form a round opening in unit lower case 18 and an oblong opening in supporting member 5, or to form both openings in an oblong shape, provided the other supporting pin 7 is mounted accordingly. Any of these constructions will compensate for any abnormalities during rotation and operation of the above referenced construction.

Reference is now made to FIG. 2, FIG. 3, FIG. 11 and FIG. 12, wherein toner replenishing means and toner transport means for transporting and circulating the toner will be described.

A toner tank 20 is constructed so as to be freely mountable and removable from image forming unit U1. Endless coil spring 31 for circulating and transporting toner is sealed within unit upper case 17 and unit lower case 18. Toner tank 20 has a predetermined quantity of toner in its inside area. Toner tank 20 is set in image forming unit U1 when toner tank 20 is full of toner, and is removed and replaced with a new toner tank 20 when all the toner in original toner tank 20 has been consumed.

Figure 11:
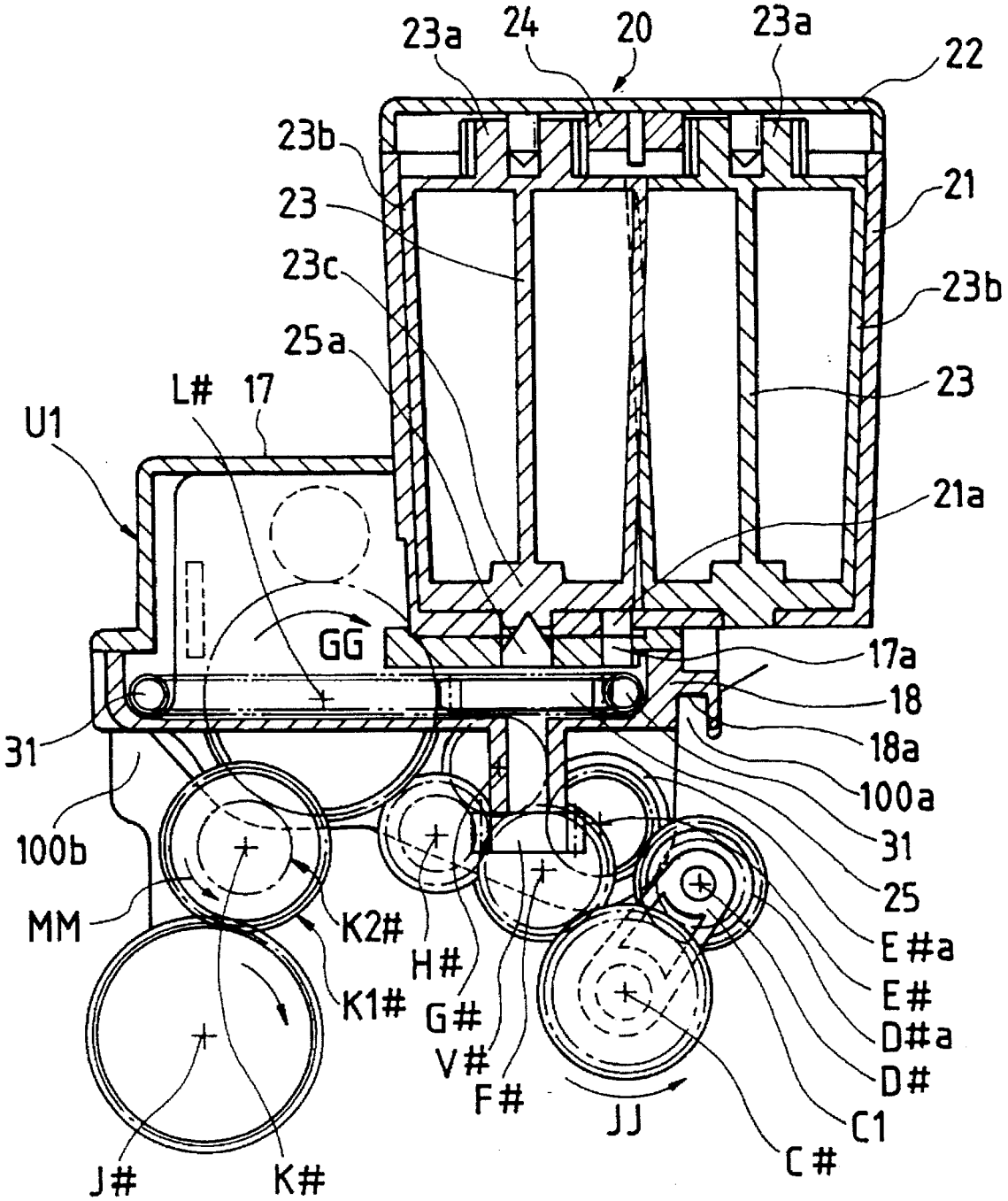
FIG. 11 is a partially sectioned fragmentary side elevational view of the image forming unit of the preferred embodiment of the present invention.

As shown in FIG. 11, toner tank 20 consist of a tank case 21 which is formed in a cylindrical shape with a bottom, and a cover 22 which is fixed on the upper part of tank case 21 and seals the toner into toner tank 20. A plurality of rotatable agitators 23 are sealed together within toner tank 20 along with the toner. Agitators 23 have a plurality of fins **23*b*** for agitating the toner.

A driving means 25 which drives coil spring 31 is disposed and sealed in one part of a toner transport channel, designed to house an endless coil spring 31, defined by unit upper case 17 and unit lower case 18. Coil spring 31 is disposed to circulate and transport toner in the direction indicated by Arrow FF in FIG. 12. Driving means 25 has a convex part **25*a* which protrudes from unit upper case 17. The upper end portion of convex part 25*a* is formed in a wedge shape. When toner tank 20 is installed in its predetermined position, convex part 25*a* engages a concave part 23*c* formed in the lower end portion of agitator 23, thereby driving and rotating agitator 23**.

Driving means 25 for endless coil spring 31 can be any rotary member so long as it can be engaged with endless coil spring 31. A preferred embodiment consists of a helical gear, having a twist angle approximating the lead angle of endless coil spring 31, which engages with endless coil spring 31.

A gear **23*a* is formed in the upper end portions of each of agitators 23. As shown in FIG. 11, gear 23*a* on agitator 23 to the left is rotated with agitator 23 by convex part 25*a*. Gear 24 is in turn rotated by gear 23*a*. Gear 24 then rotates gear 23*a* of the agitator 23** on the right, thereby rotating that agitator.

Toner, which is agitated by the rotation of agitators 23, is dropped by its own weight into the toner transport channel, in which endless coil spring 31 is disposed for circulating and transporting the toner. The toner falls through an opening **21*a* formed in the bottom area of tank case 21 and an opening 17*a* formed in unit upper case 17 which is coaxial with opening 21*a*. Moreover, opening 21*a* and opening 17*a* are opened and closed coincidently with the mounting and removal of toner tank 20** by a mechanism not shown.

The toner which has dropped by its own weight into the toner transport channel in which endless coil spring 31 is disposed is circulated and transported in the direction indicated by Arrow FF in FIG. 12. Being driven by driving means 25, endless coil spring 31 moves the toner to toner storage unit 11. The toner falls by its own weight from a point above feeding roller 13 into toner storage unit 11 as shown in FIG. 4. Since toner storage unit 11 is constructed so as to be extremely narrow, if toner storage unit 11 is filled with toner, toner will not drop from endless coil spring 31 into toner storage unit 11. In addition, toner will not fall from toner tank 20 into the toner transport channel since no additional toner is yet needed.

The above description describes the image forming means of this preferred embodiment. Image forming unit U1 is mountable and detachable from the main unit of the image forming apparatus, making it possible to detach the image forming unit U1 as an integrated unit so that repair work may be performed on image forming unit U1 or so that image forming unit U1 thus detached may be replaced with another image forming unit.

Figure 3:
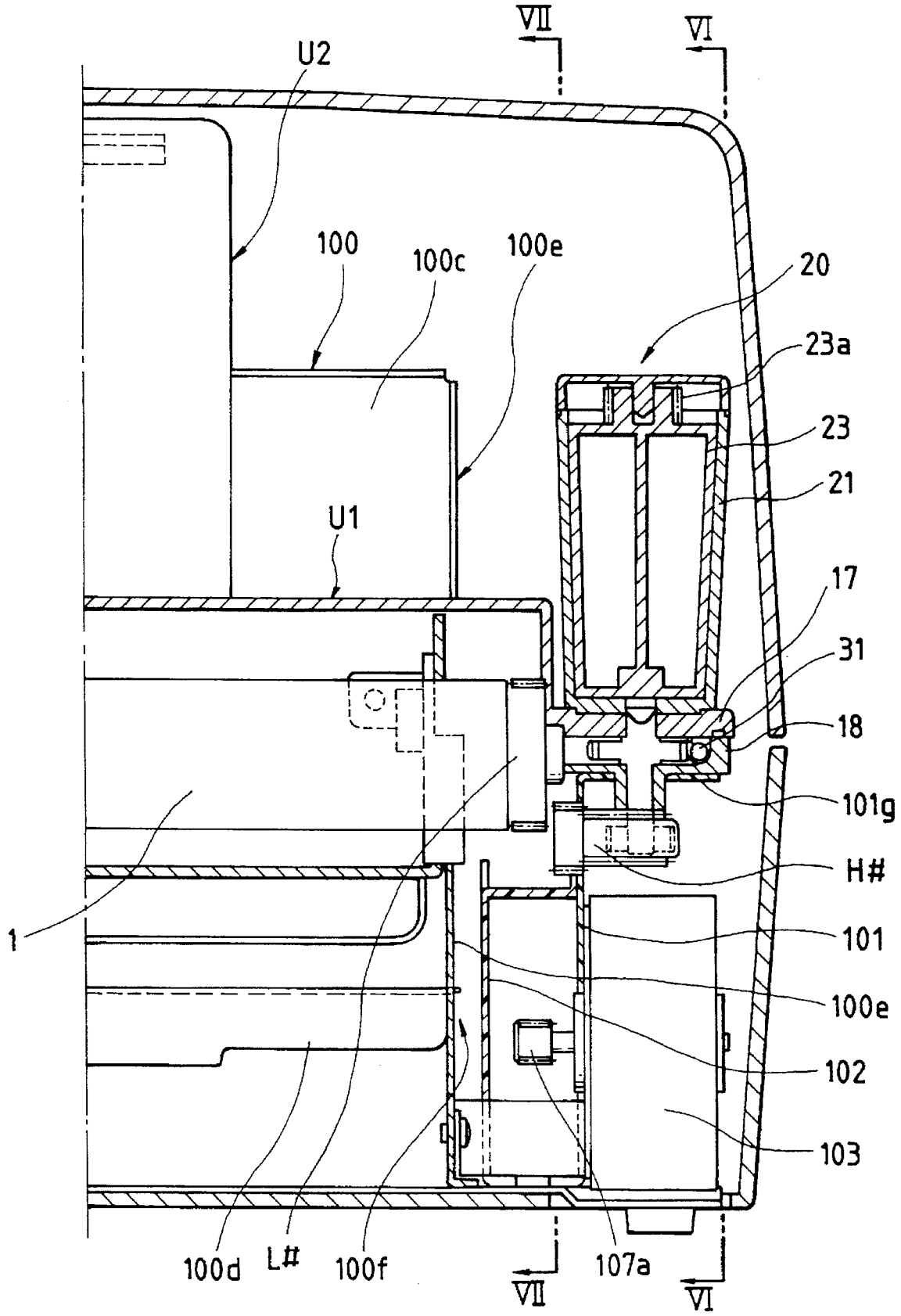
FIG. 3 is a partial, enlarged cross-sectional view of the image forming apparatus as taken along the line III—III shown in FIG. 6.

The relationship between image forming unit U1 and the main unit of image forming apparatus 180 is described with reference to FIG. 11. A concave part **18*a* is formed as a positioning part on unit lower case 18 to furnish a point of reference for positioning image forming unit U1. A convex part 100*a* formed as a positioning part on a main frame 100 serves as a point of reference for the internal construction of the image forming apparatus. Convex part 100*a* is engaged with concave part 18*a*, and image forming unit U1 is thereby positioned in the height direction and in the horizontal plane. An additional convex part 100*b* which is symmetric with convex part 100*a* aids in the positioning of the image forming unit in the height direction. This part is located opposite convex part 100*a*. The image forming unit is fixed on main frame 100 by fixing means such as screws (not shown). Further, as shown in FIG. 3, a horizontally deformed portion 101*g*, which forms a part of driving unit U3 described below, is formed on the upper area of sheet metal member 101. One end portion of image forming unit U1 is mounted on bent portion 101*g* and rigidly secured by appropriate fixing means. Thus, bent portion 101*g*** also constitutes a positioning part for image forming unit U1.

Main frame 100 is formed as a sheet metal construction as shown in FIG. 1, FIG. 3 and FIG. 12. As shown in FIG. 1, main frame 100 is a sheet metal construction which is bent into an L shape to form first face **100*c*, which positions and holds exposing unit U2 which will be described in detail below, and a second face 100*d*, which positions and holds a fixing unit 60, a sheet material transport unit 70, and an image transfer unit 80, all of which will be described in detail below. As illustrated in FIG. 3 and in FIG. 12, main frame 100 is also bent to form a third face 100*e* which crosses first face 100*c* and second face 100*d* at right angles. Third face 100*e* is formed in an L shape when viewed from the side in FIG. 7. Although the area of the left side off the chain line is omitted from FIGS. 3 and 12, the omitted parts are the same as on the right side shown in FIGS. 3 and 12, and another third face 100*e*** is formed there.

As shown in FIG. 12, in order to position first face **100*c*, second face 100*d*, and third face 100*e* properly and also to increase the rigidity of the structure, the sheet metal structure is constructed so that an opening is formed in third face 100*e* and a convex connecting part 100*f*, which is engaged with this opening, is formed in second face 100*d*. A connecting part 100*f* is formed in third face 100*e* for engaging the opening in second face 100*d*and the convex part in third face 100*e*. This construction achieves high positioning accuracy without any structural strain among first face 100*c*, second face 100*d*, and the third 100*e*, and also achieves high rigidity owing to the effect of the connecting part 100*f***.

It is to be noted that connecting part **100*f* would be effective even if it merely coupled the two faces. However, connecting part 100*f*** used in the preferred embodiment has been prepared in such a manner that it also tightens while connecting the two faces.

Referring to FIG. 1, image transfer unit 80 will now be described. Image transfer unit 80 transfers a toner image developed on photosensitive drum 1.

The principal parts of image transfer unit 80 in this preferred embodiment are urged toward photosensitive drum 1 from a point below transfer unit 80 with a total pressure amounting to several hundred grams applied by a pressing mechanism (not shown). Image transfer unit 80 is provided with means for applying a 1 kV DC bias of reverse polarity to that of the toner image developed on photosensitive drum 1. Image transfer unit 80 further comprises a freely rotatable image transfer roller 81, which is formed of a conductive or semi-conductive elastic material, such as a rubber material, and a sheet material transporting base 71, which supports image transfer roller 81 and works together with the principal component parts of sheet material transporting unit 70 as described below. Sheet material transporting base 71 is set in its predetermined position by the engagement of a positioned part 71*a* with a positioning part formed on main frame 100, which serves as a point of reference for the internal construction of image forming apparatus 180, and is fixed on main frame 100 by such fixing means as screws and the like.

The toner image which has been transported to the nip area, formed by the pressing action between photosensitive drum 1 and image transferring roller 81, is transferred as it passes this nip area to a sheet material supplied by sheet material transporting unit 70, which will be described in detail below.

Next, fixing unit 60 which receives a sheet material with a toner image transferred thereto from photosensitive drum 1 and performs a fixing process on the toner image will be described.

The principal parts of fixing unit 60 in this preferred embodiment are a fixing roller 63, a pressurizing roller 67, an operating lever 68, a cam 69, a pair of paper discharging rollers 61, and a fixing base 64.

Fixing roller 63 is arranged on the downstream side of photosensitive drum 1 in the direction of transport of the sheet material. Fixing roller 63 is freely rotatable with a heat generating body, such as a halogen heater, built into the hollow portion of an aluminum pipe material at its center.

Pressurizing roller 67 is urged by a total force of several kg toward fixing roller 63 by a pressing mechanism comprising a lever 66 which is freely displaceable upon application of force from a pressing member. In this preferred embodiment, this pressing member is a spring. Pressurizing roller 67 works as a pressing means and presses the toner image transferred onto the sheet material. At least the surface of pressurizing roller 67 is formed of a semi-conductive elastic material, such as silicone rubber. Pressurizing roller 67 rotates at a peripheral velocity identical to that of fixing roller 63. The toner image is transferred to the sheet material of image transfer unit 80. Through the fixing process, a toner image on a sheet material being printed, which has been transported from image transfer unit 80 to the nip area formed by the pressing action between fixing roller 63 and pressurizing roller 67, is fixed on this sheet material at a predetermined temperature.

Operating lever 68 can be moved from a first position indicated by a solid line in FIG. 1 to a second position indicated by the dual dot chain line in FIG. 1, in order to engage or release the pressing force exerted by the pressing mechanism comprising lever 66. Operating lever 68 can be operated from the front face of the apparatus.

Cam 69 is displaceable in the direction indicated by Arrow EE as shown in FIG. 1, and is in interlocking contact with operating lever 68. Cam 69 is constructed so the pressing force applied by the pressing mechanism comprising lever 66 is released when cam 69 is rotated in the counter-clockwise direction.

The pair of paper discharging rollers 61 discharge the sheet material to the outside of the apparatus after the sheet material has passed through fixing roller 63 and pressurizing roller 67 with an image being fixed thereon.

Fixing base 64 supports the component parts of fixing unit 60, and the fixing unit 60 is formed into a unitary structure with fixing base 64. Fixing base 64 is set in its predetermined position by the engagement of positioned part 64*a* and a corresponding positioning part which is formed on main frame 100. Fixing base 64 is fixed on main frame 100 by fixing means such as screws.

Next, sheet material transporting unit 70 will be described. Sheet material transporting unit 70 transports and feeds a sheet material, such as paper, to image transfer unit 80. A paper feeding tray 72, which contains a large number of sheets of a sheet material P, such as paper, is set in the rear part of image forming apparatus 180. A generally known pushing mechanism 74 is provided which is set in the lower end part of image forming apparatus 180 and selectively pushes sheet material P toward a freely rotatable paper feeding roller 73. Paper feeding roller 73 is formed of a material such as rubber with high friction resistance and is provided in sheet material transporting unit 70. Paper feeding tray 72 is freely attachable and detachable to the main unit of image forming apparatus 180.

Sheet material transporting unit 70 at the side of the main unit of image forming apparatus 180 is composed of sheet material transporting base 71, paper feeding roller 73, a sheet material transport control mechanism 75, a sheet material guide 76, and a sheet material detecting means 77.

Sheet material transport control mechanism 75 is disposed in opposition to paper feeding roller 73 and separates sheet material P to ensure that only the one piece of sheet material P in the uppermost position with respect to a large number of pieces of sheet material P is transported and fed by paper feeding roller 73.

Sheet material guide 76 is disposed in opposition to sheet material transporting base 71 and is designed to guide the sheet material toward image transfer unit 80. Sheet material detecting means 77 is arranged in the sheet material transporting path and is provided with photosensors or the like for detecting the presence or absence of a sheet material.

Sheet material transporting base 71 supports image transferring roller 81 and also supports the principal components of sheet material transporting unit 70 mentioned above. Sheet material transporting base 71 is provided with a mechanism (not shown) which is connected by an operating means such as a link mechanism to a pressing force releasing mechanism. This mechanism works with operating lever 68, which can be operated at the front face of the apparatus of fixing unit 60, and can release the pressing force exerted by image transfer roller 81 onto photosensitive drum 1.

Sheet material transporting unit 70 and image transfer unit 80 are formed into a unitary structure with sheet material transporting base 71. Sheet material transporting base 71 is set in its predetermined position by the engagement of positioned part 71*a* with a positioning part formed on the main frame 100, which provides a reference point for the internal construction of the apparatus. Sheet material transporting base is fixed on main frame 100 by fixing means such as screws. When paper feeding roller 73 is rotated in the construction described above, one piece of the sheet material is transported via the sheet material transporting path and is supplied to image transfer unit 80.

The feed control for the sheet material will now be described. Paper feeding roller 73 is rotated after receiving a command and transports one piece of sheet material P through the sheet material transport path and paper feeding roller 73. The sheet material stops in response to a detecting signal generated by the sheet material detecting means 77, and is held in a stand-by position waiting for the toner image to be transferred thereto.

Paper feeding roller 73 may be stopped upon the reception of a detecting signal generated by sheet material detecting means 77, or after the elapse of a prescribed duration of time after the detecting signal is generated. That is to say, it is acceptable to control the time so that the toner image, developed on photosensitive drum 1 in the nip area formed by the contact of developing roller 12 and photosensitive drum 1 under pressure, reaches image transfer unit 80, in which a nip area is formed by the contact of photosensitive drum 1 with image transferring roller 81 under pressure by the effect of rotation of the photosensitive drum 1, at the same time at which the sheet material is fed from the above-mentioned stand-by state and reaches image transfer unit 80.

In this preferred embodiment, sheet material detecting means 77, which comprises a photosensor or the like for detecting the presence or absence of a sheet material, is disposed in the sheet transporting path in sheet material transporting unit 70. A second sheet material detecting means (not shown), similar to sheet material detecting means 77, is provided on the downstream side in the direction of the transport of the sheet material from the nip area formed between fixing roller 63 and pressurizing roller 67 in fixing unit 60. Both sheet material detecting means detect the state of the sheet material being transported. Both sheet material detecting means 77 and this second sheet material detecting means generate detecting signals that are then processed to maintain a predetermined sheet material position. These detecting means perform supervisory control over the state of sheet material, and also monitor for a potential paper jam in the apparatus.

The image forming apparatus of this preferred embodiment is capable of performing a jam processing operation which will now be described. If a paper jam is found in sheet material transporting unit 70, the sheet material is moved toward the rear part of image forming apparatus and is ejected. If a paper jam has occurred in fixing unit 60, the sheet material is moved out toward the front part of image forming apparatus 180 by releasing the pressing force which pressurizing roller 67 exerts on the fixing roller 63 and also by releasing the pressing force which image transferring roller 81 exerts on photosensitive drum 1 by moving operating lever 68, which can be operated at the front face of the apparatus.

Exposing unit U2, which exposes photosensitive drum 1 in order to make a latent image formed there will now be described. The principal parts of exposing unit U2 are a motor 41, which rotates at greater than ten thousand rpm, a control circuit board (not shown) which controls the revolutions of motor 41, a polarized scanning means 43 which is mounted on the output shaft of motor 41, and revolves and performs a polarized scan of the beam of light emitted from light emitting elements such as semiconductor laser elements (not shown), a reflecting mirror 44 or the like, which irradiates this beam of light 49 toward photosensitive drum 1, and a case 42, which is formed into a unit containing the principal component parts mentioned above. Case 42 is set in its predetermined position by the engagement of at least one positioned part **42*a* with a positioning part formed on main frame 100, which provides a point of reference for the internal construction of the apparatus. Case 42 is positioned and fixed on main frame 100 by fixing means such as screws. Note that positioning parts 42*a*, 64*a* and 71*a* may be tabs formed integral with case 42, fixing base 64 and sheet material transporting base 71, respectively, and which engage in apertures in or against a side of main frame 100**.

Polarized scanning means 43 makes it possible to offer a compact and low-priced optical scanner as is described in detail in the Patent Application No: 121995-1993 (Heisei 5), which was filed earlier by the present Applicant. The length of the optical path leading from polarized scanning means 43 to photosensitive drum 1 in this preferred embodiment is set at approximately 200 mm. Shorter lengths of the optical path of approximately 140 mm would also properly fulfill the scanning needs.

Control unit 50, which controls the individual units and parts described above will now be described. The principal parts of control unit 50 are disposed in the bottom portion of image forming apparatus 180. At least a power source circuit unit and an operating control circuit unit for each of the previously described units (i.e. image forming unit U1, etc.) are disposed within control unit 50. Also disposed within control unit 50 are connecting means for inputs and outputs, such as interface connectors for reception of signals from external devices, and power source input connectors (not shown). Control unit 50 is set in a compact and centralized arrangement. The principal parts of control unit 50 are disposed in the lower area of second face **100*d* of main frame 100**, which is connected to ground together with an electrically conductive sheet metal member of the driving unit, thus providing a shielding means for electro-magnetic radiation generated in the inside area of the control unit.

The driving relations of the individual structural parts described above will now be described making reference to FIG. 2, FIG. 3, FIG. 6, FIG. 7, FIG. 8, FIG. 9, FIG. 10, FIG. 11, FIG. 12 and FIG. 13.

The principal parts of the driving force transmission unit in this preferred embodiment are disposed in a centralized arrangement on the right side, i.e., third face **100*e*, of main frame 100, as shown in FIG. 2 and in FIG. 12. A first wheel train mounting unit 101 is provided in spaced confrontation over most of their length with a second wheel train mounting unit 102, both of which are sheet metal members. The driving force transmission unit is provided with a driving motor 103, which is provided with a driving gear 103*a* on its output shaft. Also provided are several kinds of driving gear trains supported in such a manner as to unable them to rotate freely. These structures form a unitary construction hereinafter called driving unit U3. Driving unit U3 is set in its predetermined position by the engagement of a positioned part with a positioning part formed on third face 100*e* of main frame 100, which provides a point of reference for the internal construction of the apparatus. Driving unit U3 is positioned and fixed by fixing means such as screws 104 (see FIG. 8**).

Figure 8A:
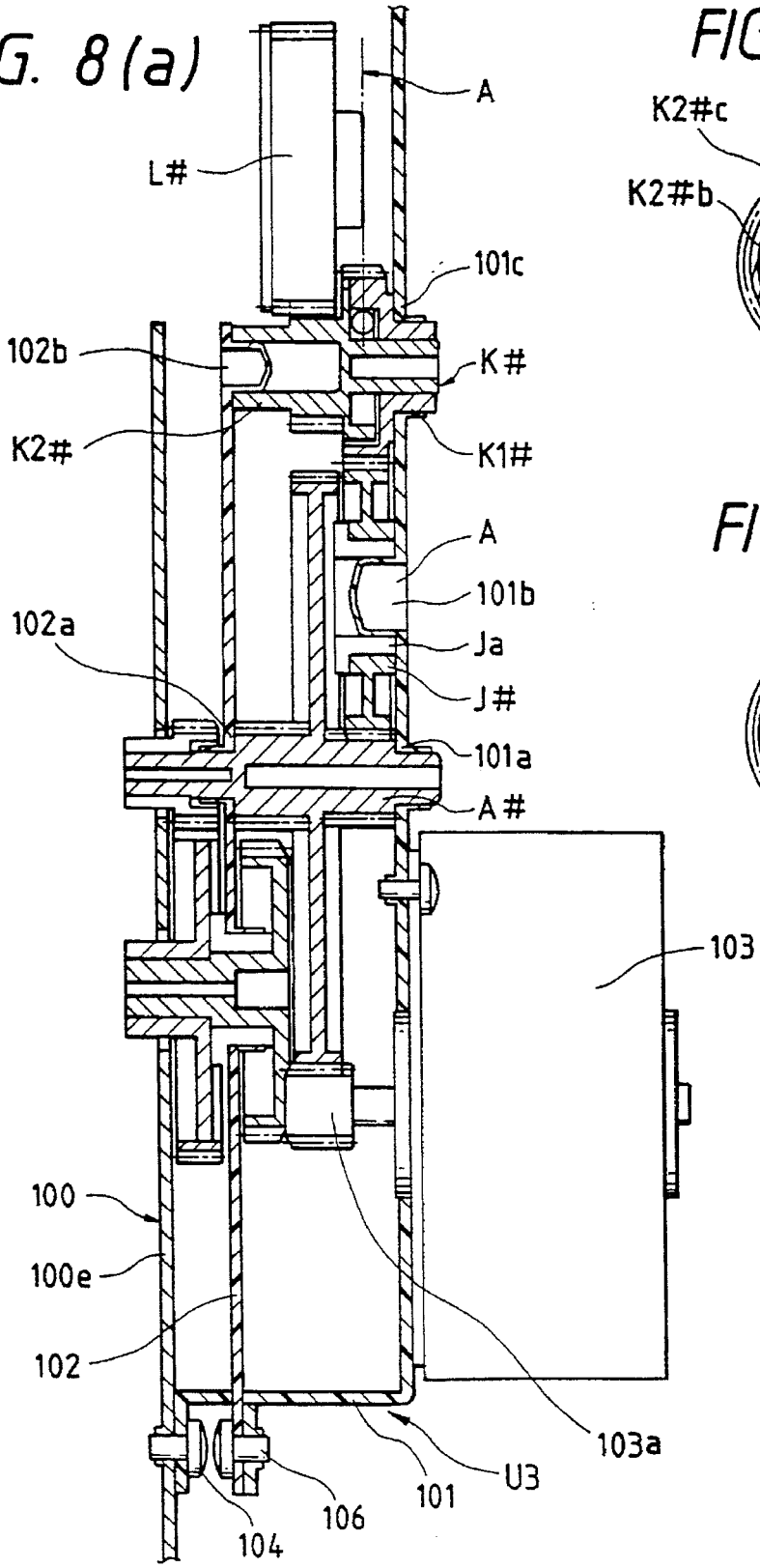
FIG. 8 illustrates a portion of the rotational driving force transmitting unit of the image forming apparatus of the preferred embodiment.
Figure 8B:
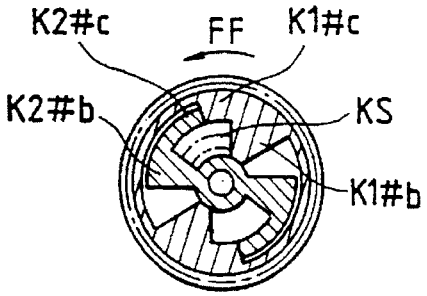
Figure 8C:
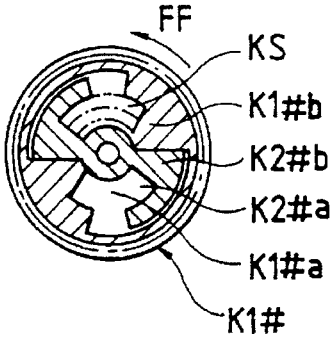

In this preferred embodiment, first wheel train mounting unit 101 and second wheel train mounting unit 102 are formed of sheet metal members. These wheel train mounting units form low-priced mounting structures for rotary members which are capable of performing stable operations through effective utilization of the advantageous features, as described below. First wheel train mounting unit 101 and second wheel train mounting unit 102 are fixed by screws 106 or the like as shown in FIG. 8.

A low-priced PM type stepping motor is employed as driving motor 103 in this preferred embodiment. The motor is driven to obtain smooth continuous revolutions by controlling the input pulses and electric current, etc.

Figure 6:
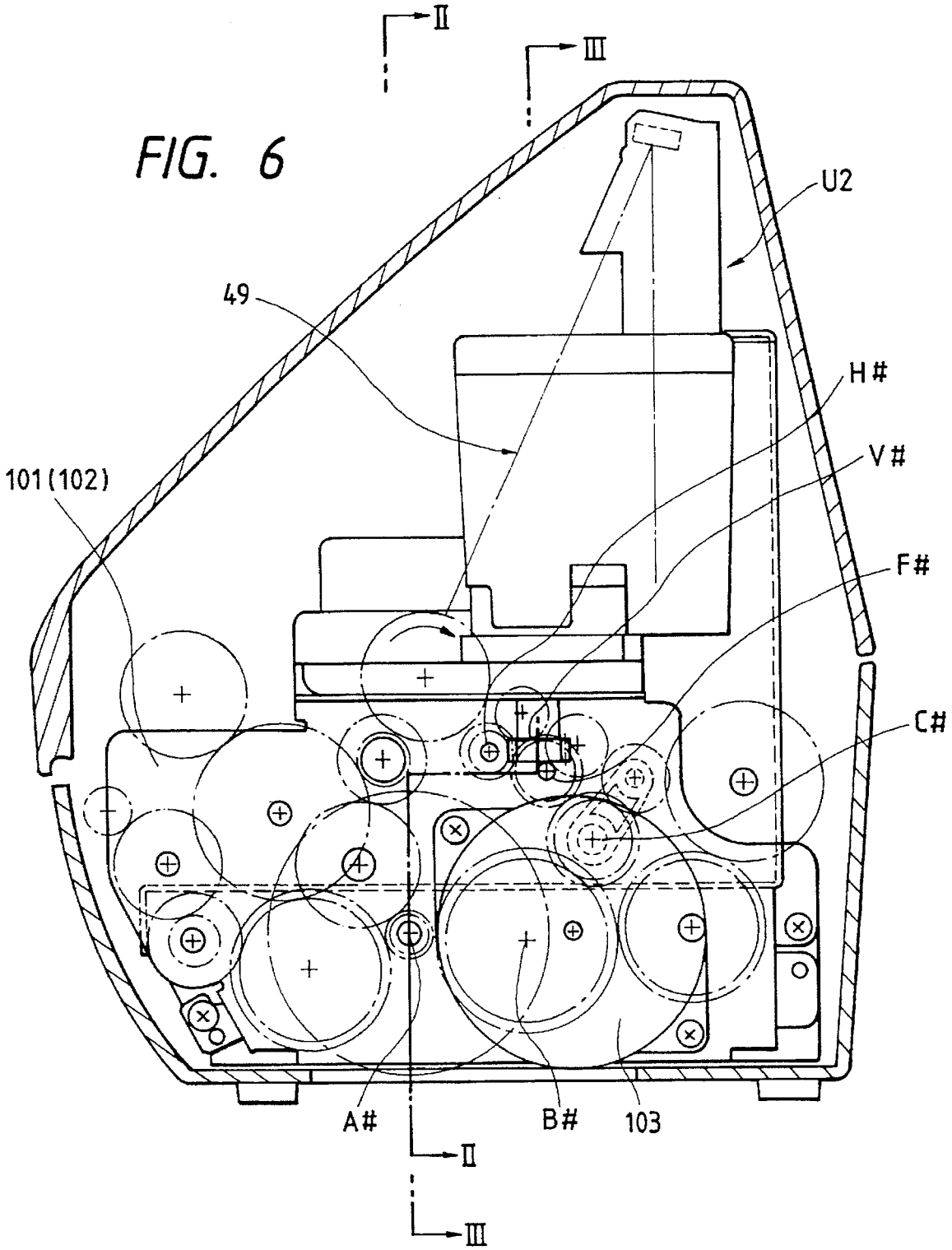
FIG. 6 is a reduced cross-sectional view of the image forming apparatus of the preferred embodiment as taken along the line VI—VI of FIG. 3.
Figure 7:
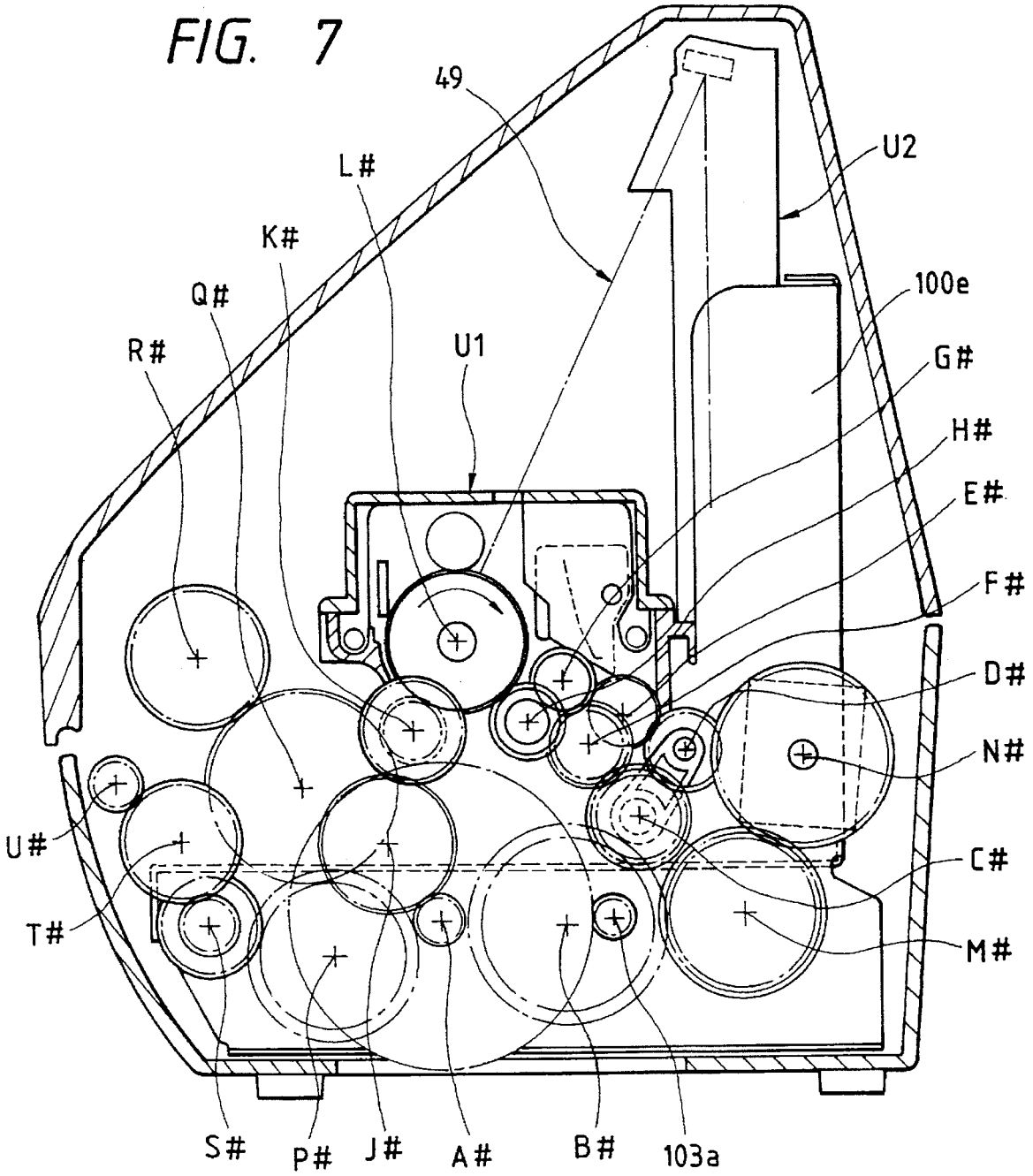
FIG. 7 is a reduced cross-sectional view of the image forming apparatus of the preferred embodiment as taken along the line VII—VII of FIG. 3.

The driving system of this preferred embodiment will now be described with reference to FIGS. 6 and 7. FIG. 6 illustrates the driving system including first wheel train mounting unit 101 and second wheel train mounting unit 102. FIG. 7 shows the individual gear trains with the two wheel train mounting units omitted. The central position (axis) for the rotation of each gear is shown by the mark "+" in both FIG. 6 and FIG. 7. (The same marking method is used also in FIG. 11 and in FIG. 13.)

Referring now to FIG. 7, the driving system of this preferred embodiment will be described, with special attention given to each of the individual driving systems. These systems will be described by the functions forward of a gear A#, since all of the individual driving systems employ driving gear 103*a* provided on the output shaft of driving motor 103 which rotates gear A#.

<First Driving System>

A first driving system is used for driving and rotating photosensitive drum 1. The driving force is transmitted in the sequence: first to gear A#, to a gear J#, to a gear K#, and to a gear L#.

Gear L# is rigidly mounted on one end portion of photosensitive drum 1 by a rigid mounting means, which, for example, may be bonding. Gear L# is thus set in a unitary construction with photosensitive drum 1, this unitary construction being attached to or detached from this first driving system by the attachment or detachment of the image forming unit mentioned above.

Attachment or detachment of image forming unit U1 in this preferred embodiment is effected by moving the image forming unit U1 in the downward or upward direction, respectively as viewed in FIG. 7.

<Second Driving System>

The second driving system is used for driving and rotating developing roller 12, which is a principal component part of developing unit 10. The driving force is transmitted in the sequence: first to the gear A#, then to a gear B#, to a gear C#, to a gear F#, and to a gear G#.

Gear G# is rigidly mounted by a rigid mounting means such as a pressure fitting process at the top end portion of a support member 12*a* (FIG. 4) extending from one end side of developing roller 12. Gear G# is connected to or disconnected from this second driving system by the attachment or detachment of image forming unit U1.

<Third Driving System>

The third driving system is used for driving and rotating feeding roller 13, which is one of the principal parts of the above-mentioned developing unit 10. The driving force is transmitted in the sequence: first to gear A#, to gear B#, to gear #C, to a gear #D, and to a gear E#.

Gear E# is rigidly mounted by a rigid mounting means such as a pressure fitting process at the top end portion of a supporting part 13*a* extending from one end side of feeding roller 13. Gear E# is connected to or disconnected from this third driving system by the attachment or detachment of image forming unit U1.

<Fourth Driving System>

The fourth driving system is used to drive driving means 25, which drives coil spring 31 in an endless coil spring system for circulating and transporting the toner, and agitator 23 in toner tank 20 to rotate agitator 23. The driving force is transmitted in the sequence: first to gear A#, to gear B#, to gear C#, to gear F#, to a gear H#, and to a gear V# (shown in FIG. 6).

Gear V# is a helical gear which is rigidly mounted by a rigid mounting means such as a pressure fitting process at one end side of driving means 25. Gear H#, which drives gear V#, is a freely rotating helical gear supported on unit lower case 18 of image forming unit U1. Gear H# is connected to or disconnected from this fourth driving system by the attachment or detachment of image forming unit U1.

<Fifth Driving System>

The fifth driving system is used for driving and rotating paper feeding roller 73. The driving force is transmitted in the sequence: first to gear A#, to gear B#, to a gear M#, and to a gear N#.

Gear N# is a gear which is provided to a clutch (not shown) disposed at the side of one end of paper feeding roller 73. Gear N# is constantly connected to this fifth driving system.

<Sixth Driving System>

The sixth driving system is used for driving and rotating fixing roller 63. The driving force is transmitted in the sequence: First gear #A, to a gear Q#, and to a gear R#.

Gear R# is mounted at the side of one end of fixing roller 63. Gear R# is constantly connected to this sixth driving system.

<Seventh Driving System>

The seventh driving system is used for driving and rotating the pair of paper discharging rollers 61. The driving force is transmitted in the sequence: first to gear A#, to gear P#, to a gear S#, to a gear #T, and to a gear U#.

Gear U# is mounted at the side of one end of the pair of paper discharging rollers 61. Gear U# is constantly connected to the seventh driving system.

As described above, the driving systems in this example of preferred embodiment are divided to apply their driving force separately to the individual principal component parts of image forming apparatus 180 in order to avoid the concentration of the rotational driving force on one location.

A detailed description of principal parts of the individual driving systems will now be given.

<First Driving Systems>

The first driving system is used for driving and rotating photosensitive drum 1. The driving force is transmitted in the sequence: first to gear A#, to gear J#, to gear K#, and to gear L#. The construction of the first driving system is shown in FIGS. 8*a*–8*b* and in FIG. 11. FIG. 8*a* is a cross sectional view of the first driving system taken along the line drawn through the rotational axes of the gears in that system.

Driving gear 103*a*, which is mounted on the output shaft of driving motor 103, which is in turn mounted on the first wheel train mounting unit, drives gear A#. Gear A# is freely rotatably supported between burring parts 101*a* and 102*a* respectively formed with their inside surfaces polished to a mirror-smooth finish in first wheel train mounting unit 101 and second wheel train mounting unit 102. Driving gear A# drives gear #K by way of gear J#, which is freely rotatably supported via a bush Ja pressure fitted onto a projecting part 101*b* of first wheel train mounting unit 101. Gear K# is in contact with second wheel train mounting unit 102 and further drives gear L#.

Gear L# is constructed to be connected to or disconnected from this first driving system by the attachment or detachment of the image forming unit U1. This preferred embodiment features a dual construction comprising a gear K1# and a gear K2#, which are employed in place of gear K# as a means of more easily engaging gear K# and gear L# during attachment or detachment of the image forming unit U1. Gear K1# is supported in burring part 101*c* of first wheel train mounting unit 101, which enables gear KI# to rotate freely while supported by burring part 101*c* formed with its inside surface polished to a mirror-smooth finish. One end portion of gear K2# is supported by a projecting part 102*b* of second wheel train mounting unit 102. Projecting part 102*b* has its outer circumferential area polished to a mirror-smooth finish, and is received in an axial recess in gear K2#. The other end portion of gear K2# is inserted into the inside area of gear K1# and is freely rotatably supported therein. Thus, the combined gears K1# and K2# are held between first and second wheel train units 101, 102.

Gears K1# and K2# are constructed so as to be capable of rotating in one unified structure. The dual construction portions of gear K1# and gear K2# are provided, as shown in the cross-sectional view as seen along lines A—A (FIGS. 8(*b*) and 8(*c*)), with a concave part K1#*a* and a convex part K1#*b* respectively formed in positions thereby achieving a point-to-point symmetrical relationship, on gear K1#. They are also formed with a concave part K2#*a* and a convex part K2#*b* formed respectively in positions achieving a point-to-point symmetrical relationship with the concave parts and the convex parts thus formed on gear K1# and gear K2#. The gears are fitted into mutual engagement with a compressive spring KS provided between the convex parts K1#*b* and K2#*b* on the gears. Therefore, gear K1# and gear K2# can be rotated by a prescribed angle relative to each other, and, if no external force works on these gears, they are maintained as shown in FIG. 8(*c*) by the urging force applied by compressive spring KS. When gear K1# is driven in the direction indicated by Arrow FF, the second convex parts K1#*c* and K2#*c* formed on the convex part K1#*b* of gear K1# and convex part K2#*b* of gear K2# are brought into mutual contact by a force opposing the urging force exerted by compressive spring KS, as shown in FIG. 8(*b*), so that gear K2# is thereby driven to rotate in the direction indicated by Arrow FF.

When image forming unit U1 is installed with such a dual structure, gear K#2 is engaged with gear L#, and consequently has a rotational load so that gear K2# remains stopped and compressive spring KS is compressed when gear K1# is driven to rotate in the direction indicated by arrow F and only the gear K1 is rotated. Second convex part K1#*c* on gear K1# is brought into direct contact with the second convex part K2#*c* on gear K2# in a brief period of time, as shown in the cross-sectional view seen in FIG. 8(*b*), and gear K2# is thereby driven to rotate in the direction indicated by Arrow FF, so that gear L# is driven in the direction indicated by Arrow GG in FIG. 11.

When the image forming unit U1 is removed upward as shown in FIG. 11, gear L# is stopped from its rotation after being rotated in the direction indicated by Arrow GG in FIG. 11, and gear L# and gear K2# can be detached from each other without any excessive strain from their engagement, gear K2# being thereby released from the rotational driving load. Compressive spring KS expands and thereby rotates gear K2# in the direction indicated by Arrow FF in FIG. 8(*c*), and compressive spring KS is restored to its original state.

When image forming unit U1 is installed downward from above as shown in FIG. 11 while gears K1# and K2# are in the condition shown in FIG. 8(*c*), gear L# rotates gear K2# as shown in FIG. 11 in the direction reverse to the ordinary rotating direction (in the direction opposed to Arrow MM, in the clockwise direction) by a predetermined angle in counteraction with the expanding force of the compressive spring KS. Thus, gear L# and gear K2# are engaged with each other, since gear L# has a driven rotational load generated by the relation of the contact under pressure between photosensitive drum 1 and developing roller 12. Second convex part K1#*c* and second convex part K2#*c* do not reach the state shown in FIG. 8(*b*) when gear K2# is rotated by the predetermined angle in the clockwise direction (as viewed in FIG. 8(*b*)) when image forming unit U1 is installed in its position.

<Second Driving System>

Figure 9A:
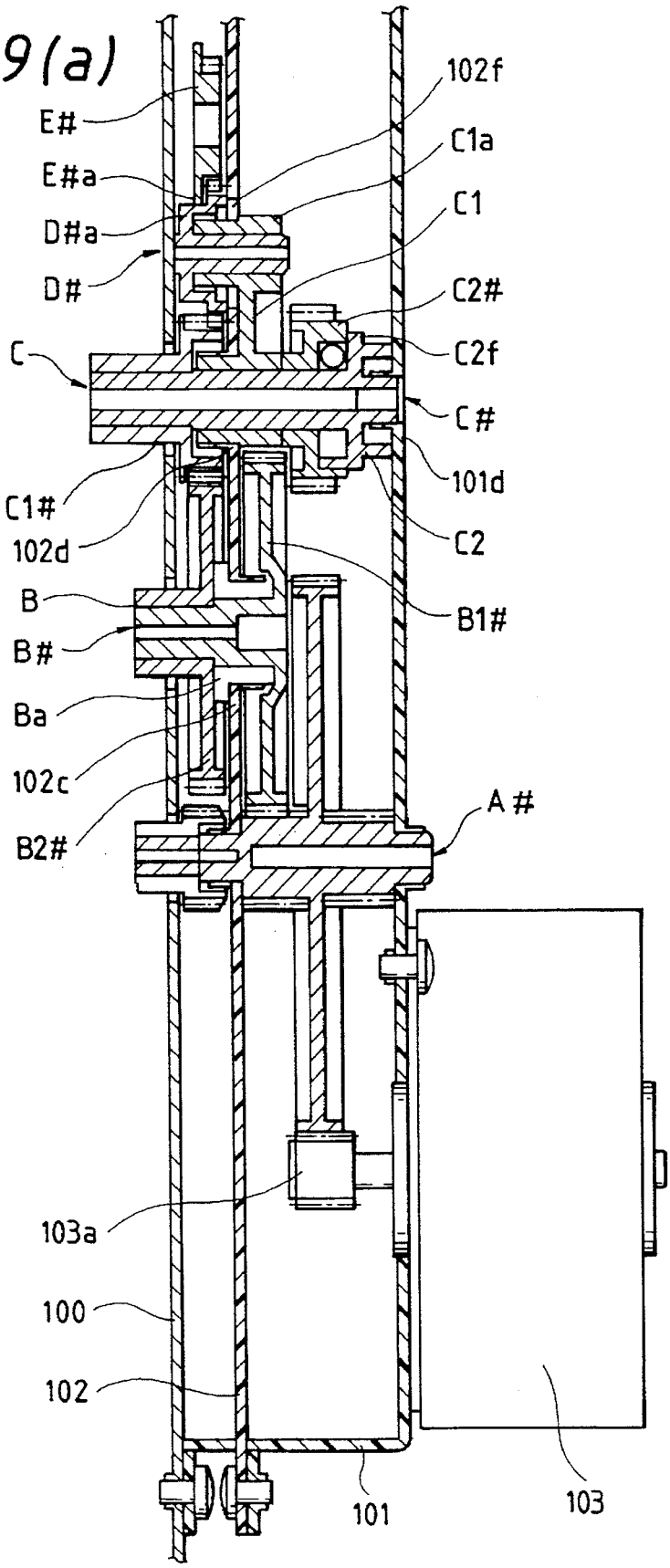
FIG. 9 illustrates a portion of the rotational driving force transmitting unit of the image forming apparatus of the preferred embodiment.
Figure 9B:
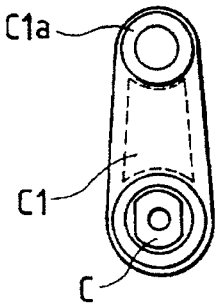
Figure 9C:
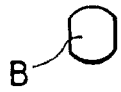

The second driving system is used for driving and rotating developing roller 12, which is a principal component part of developing unit 10. The driving force is transmitted in the sequence: first to gear A#, then to gear B#, to gear C#, to gear F#, and to gear G#. This construction is shown in FIGS. 9(*a*)(*b*) and (*c*), FIGS. 10(*a*), (*b*) and (*c*) and FIG. 11. FIG. 9(*a*) and FIG. 10(*a*) are cross-sectional views of this second driving system taken along a line drawn through the rotational axes of some of the gears in that system.

The relation between first wheel train mounting unit 101 and driving motor 103 and the relation among the first wheel train mounting unit 101, second wheel train mounting unit 102 and gear A# are the same as those relations in the first driving system described above. These relations are therefore omitted from the description given here, and the driving system forward of gear A# will be described.

Gear A# drives gear C# via gear B#, which is supported by way of a bush Ba pressure-fit into burring part 102*c*, which is provided on second wheel train mounting unit 102. Gear A# also drives gear F# (shown in FIG. 10), the rotational driving force being transmitted to gear G#.

Gear B# is composed of gear B1# and gear B2#, which are capable of rotating in one block, being connected under pressure by an oval shape engaging part B shown in FIGS. 9(*a*) and 9(*c*).

Gear C# in the wheel train at the next stage is driven by a driving force transmitted from gear B2#, which branches the rotational driving force to be transmitted to the third driving system described below. The first principal part of gear C# is a tumbler arm C1, which has a bearing function derived from being freely rotatably supported in second wheel train mounting unit 102 by burring part 102*d* formed with the inside surface thereof polished to a mirror-smooth finish, and a tumbler function, which will be described below. Another principal part of gear C# is a main shaft C2, which is inserted through tumbler arm C1 and is freely rotatably supported by first wheel train mounting unit 101 by burring part 101*d* which is formed with the inside surface thereof polished to a mirror-smooth finish. The other principal parts of gear C# are a gear C2#, which is guided in the thrust direction by tumbler arm C1 and a collar part C2*f* of main shaft C2 and is freely rotatably supported with main shaft C2 as described below, and a gear C1#, which is driven by a driving force supplied from gear B2#, which can rotate in a unified structure with main shaft C2 with which it is pressure-fit connected by oval-shaped engaging part C, as seen in FIG. 9(*a*). Gear C# drives gear G# to rotate with a driving force transmitted from gear C2# via gear F#.

Figure 10A:
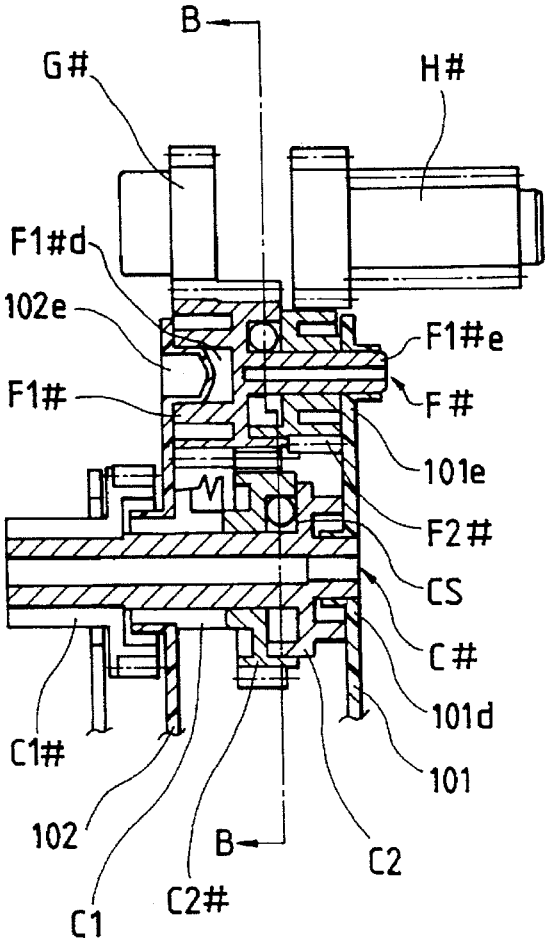
FIG. 10 illustrates a portion of the rotational driving force transmitting unit of the image forming apparatus of the preferred embodiment.
Figure 10B:
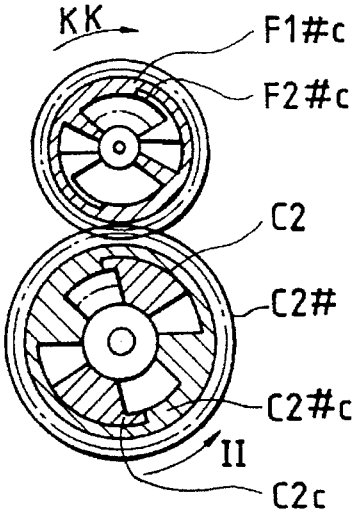
Figure 10C:
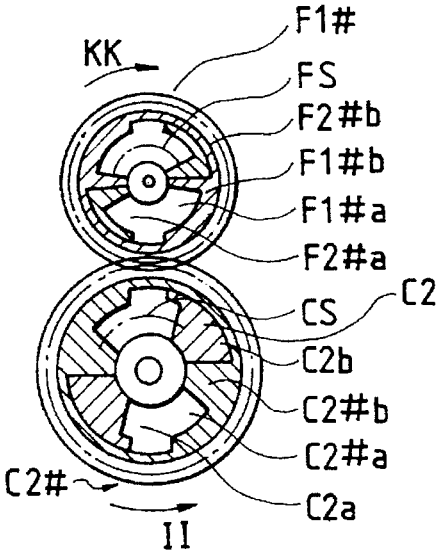

Gear F# is composed of a gear F1# and a gear F2# as shown in FIG. 10(*a*). Gear F1# has a hole part F1#*d* at one end portion thereof supported by a projecting part 102*e*, formed with its outer circumferential area polished to a mirror-smooth finish, provided in second wheel train mounting unit 102 and another end portion F1#*e* freely rotatably supported by burring part 101*e* formed with the inside surface thereof polished to a mirror-smooth finish in first wheel train mounting unit 101. Gear F2# is freely rotatably supported on shaft part F1#*e* of gear F1#.

Gear F# is formed as a dual structure composed of gear F1# and gear F2#. The basic construction of gear F# is such that the gear F1# and F2# together form a unified structure which can rotate in one block in the same way as gear K# in the first driving system. The dual structure of this gear F# will be described below in the section dealing with the fourth driving system.

As mentioned above, gear G# is constructed to be connected to or disconnected from the gear F1# in this second driving system by the attachment or detachment of image forming unit UI. This preferred embodiment uses gear C# formed in a dual structure for producing the same effect as that of the gear K# in the first driving system, that of more easily engaging gear F1# and gear G# in the course of the attachment or detachment of image forming unit U1.

The portion of the dual structure consisting of gear C2# and main shaft C2 as shown in FIG. 10 is formed with a concave part C2#*a* and a convex part C2#*b* formed respectively in point-to-point symmetrical positions on gear C2# and also with a concave part C2*a* and a convex part C2*b* formed respectively in point-to-point symmetrical positions on main shaft C2, as shown in FIGS. 10(*b*) and (*c*). These concave and convex parts on gear C2# and main shaft C2 are coupled, with a compressive spring CS (as shown in a simplified form in FIGS. 10(*b*) and (*c*)), arranged between convex parts C2#*b* and C2*b*. Therefore, gear C2# and main shaft C2 can be rotated a predetermined angle relative to each other. When no external force is at work, gear C2# and main shaft C2 can be maintained as shown in FIG. 10(*c*) by the effect of the urging force of compressive spring CS. But, when main shaft C2 is driven in the direction indicated by Arrow II shown in FIG. 10(*b*), second convex parts C2#*c* and C2*c* which are respectively formed on convex part C2#*b* of gear C2# and convex part C2*b* on main shaft C2 contact in opposition to the urging force of compressive spring CS, as shown in FIG. 10(*b*), and the gear C2# is thereby driven to rotate in the direction indicated by Arrow II.

With such a dual structure, when gear C2# is engaged with gear G# by way of gear F1#, it has a rotating load when image forming unit U1 is installed. When main shaft C2 is driven to rotate in the direction indicated by Arrow II by the action of gear Ci#, compressive spring CS is compressed while gear C2# remains stopped, so that only main shaft C2 is rotated. Second convex part C2#*c* on gear C2# and second convex part C2*c* on main shaft C2 are brought into direct contact in a brief period of time, as shown in FIG. 10(*b*). Gear C2# is then driven to rotate in the direction indicated by Arrow HH, and gear G# is thereby driven by gear F1#.

When image forming unit U1 is removed upward as shown in FIG. 11 with the rotational driving operation being stopped after gear G# is driven, gear C2# and gear F1# are released of the rotational driving load, as gear G# and gear F1# are disengaged without any excessive strain because gear G# and gear F1# can be detached from each other. Compressive spring CS expands, thereby rotating gear C2# in the direction indicated by Arrow II as shown in FIG. 10(*c*) and restoring gear C2# to its original state.

On the other hand, when image forming unit U1 is installed from above as shown in FIG. 11, and gear C2# is in the condition shown in FIG. 10(*c*), gear G# rotates gear C2# in the direction opposite the ordinary rotating direction, i.e., in the clockwise direction, (against Arrow II) by a predetermined angle in counteraction to the expanding force of compressive spring CS. Gear G# and gear F1# are engaged with each other. This occurs since gear G# has a driven rotational load generated by the contact under pressure between photosensitive drum 1 and developing roller 12 or by the contact under pressure among developing roller 12, regulating blade 14, and feeding roller 13. Second convex part C2#*c* and second convex part C2*c* do not reach the state shown in FIG. 10(*b*) when gear C2# is rotated by the predetermined angle in the clockwise direction when image forming unit U1 is installed.

<Third Driving System>

The third driving system, as mentioned above, is used for driving and rotating feeding roller 13, which is one of the principal parts of developing unit 10. The driving force is transmitted in the sequence: first to gear A#, to gear B#, to gear #C, to gear #D, and to gear E#. The construction of the third driving system is shown in FIGS. 9(*a*), (*b*), (*c*); 10(*a*), (*b*) and (*c*), and 11. FIG. 9 and FIG. 10 are cross-sectional views showing this third driving system taken along a line drawn between the rotational axes of all or part of the gears at issue.

The driving operations starting with driving motor 103 and transmitted to gear C# are the same as those described with reference to the second driving system and are therefore omitted from the description given here. The driving operations from gear C# are described below.

Gear C# is driven by a driving force transmitted from gear B2#, which branches the transmission of the rotational driving force between the second driving system and the third driving system.

Tumbler arm C1, which has one end freely rotatably supported by burring part 102*c*, formed with the inside surface thereof polished to a mirror-smooth finish, in second wheel train mounting unit 102, has a bearing function and a tumbler function for the main shaft C2, and has a shaft bearing part Cla which is positioned at the other end thereof and freely rotatably supports gear D#. Shaft bearing part C1*a* is inserted into round shaped opening 102*f* formed in second wheel train mounting unit 102, and tumbler arm C1 is able to rotate in the free gaps of both gear C# and gear D#.

Gear D#, which is freely rotatably supported by shaft bearing part C1*a* of tumbler arm C1, is driven by gear C1# and thereby drives gear E#.

A planetary driving mechanism composed of gear C1#, tumbler arm C1, and gear D# will now be described. As shown in FIG. 11, the planetary driving mechanism in this preferred embodiment is constructed so that gear C# (i.e., the gear C1#) is rotated in the direction indicated by Arrow JJ. Tumbler arm C1 is urged to revolve on the same shaft core coaxial with gear C1# in the direction of the rotation of gear C# by the pressure angle of the gears at the meshing point between gear C1# and gear D#, and the friction between main shaft C2, which is driven to rotate in the direction indicated by Arrow JJ shown in FIG. 11. Tumbler arm C1 and gear D# move in a planetary movement pattern in the direction approaching gear E# while gear D# rotates on its axis and orbitally revolves around the center of the planetary movement. This planetary driving action works regardless of the presence or absence of a load on gear E#. After being moved by the planetary driving process, tumbler arm C1 is restricted in its movement by the free gap portion between opening 102*f* formed in second wheel train mounting unit 102, and shaft bearing C1*a*.

The planetary driving mechanism of this preferred embodiment employs a first circumferential part D#*a*, which, is coaxial with gear D# and a second circumferential part E#*a*, which is coaxial with gear E#. Both these circumferential parts are constructed so as to be rotatable when in direct contact with each other. The pitch distance between first circumferential part D#*a* and second circumferential part E#*a* when in direct contact is chosen so that an appropriate backlash occurs during engagement of gear D# with gear E#.

The attachment and detachment of the image forming unit U1 will now be described. Gear E# is constructed so as to be connected to or to be disconnected from gear D# in this driving system during the attachment or detachment of image forming unit U1. When the rotational driving operation is stopped after gear C# (i.e. the gear C1#) has been driven in the direction indicated by Arrow JJ in FIG. 11, gear D# and tumbler arm C1, which have been urged for their planetary movement by the planetary driving mechanism mentioned above, will be relieved of the urging force and thus released to their free state. Therefore, when image forming unit U1 is removed upward as shown in FIG. 11, gear D# is moved away from gear E#, so that it will be extremely easy to remove image forming unit U1.

On the other hand, when the image forming unit U1 is installed from above as shown in FIG. 11, gear D# and gear E# will be either engaged or have a free gap between them. When there is a free gap between them, gear C# (i.e., the gear C1#) is driven in the direction indicated by the Arrow JJ shown in FIG. 11, and gear D# will move toward gear E# while performing its planetary movement regardless of the presence or absence of any load on gear E#, and these gears will be engaged. While gear D# is moving toward gear E#, gear D# moves to a predetermined position while engaging gear E# because gear D# and tumbler arm C1 are released from the urging force.

The case in which gear D# is engaged with gear E#, so that gear E# has a proscribed rotational load generated on it, and is therefore driven to rotate, will now be described. The larger the rotational load, the larger the urging force for planetary movement of gear D#—particularly for movement of gear D# in the direction of the pressure angle of gear D# at the point of meshing of gear C1# with gear D#, so that gear D# is moved closer to gear E#. However, the movement of gear D# is restricted by direct contact with first circumferential part D#*a* and second circumferential part E#*a*, so that gear D# is driven to rotate while engaged with gear E# with an appropriate backlash remaining.

<Fourth Driving System>

The fourth driving system drives driving means 25, which drives coil spring 31 in the endless coil spring system for circulating and transporting the toner, and agitator 23 in toner tank 20 so as to rotate the agitator. The driving force is transmitted in the sequence: first to gear A#, to gear B#, to gear C#, to gear F#, to gear H#, and to gear V# shown in FIG. 6. The construction of the fourth driving system is illustrated in FIG. 9(*a*), (*b*) and (*c*), FIG. 10(*a*), (*b*) and (*c*), and FIG. 11. FIG. 9 and FIG. 10 are cross sectional views illustrating this fourth driving system taken along lines through the rotational axes of the gears at issue.

Since the driving operations starting with driving motor 103 and transmitted to gear F1# are the same as those described with respect to the second driving system, those driving operations are omitted from the description given here, and the driving operations from gear F1# forward will now be described.

As described in the section dealing with the second driving system, gear F# is constructed in a dual structure comprising gear F1# and gear F2#, in the same way as the construction of gear C#, and gear F2# is so constructed to drive gear H#, thereby driving gear V#.

Here, gear H# is connected or disconnected from this fourth driving system by the attachment or detachment of image forming unit U1. This preferred embodiment employs gear F# for performing the same action as that of gear C# in the second driving system as a means of offering greater ease in engaging gear F1# and gear H# during attachment and detachment of image forming unit U1.

The portion of the dual structure formed of gear F# and gear F2# as shown in FIG. 10 is formed with concave part F2#*a* and convex part F1#*b* formed respectively in point-to-point symmetrical positions on gear F1# and also with concave part F2#*a* and convex part F2#*b* formed respectively in point-to-point symmetrical positions on the gear F2#, as shown in FIG. 10(*c*). These concave and convex parts on gear F1# and gear F2# are fitted into mutual engagement with compressive spring FS (as shown in a simplified form in FIGS. 10(*b*) and (*c*)) provided between convex parts F1#*b* and F2#*b* formed on both these parts. Thus, gear F1# and gear F2# can be rotated relatively by a predetermined angle in relation to each other. When no external force is at work, gear F1# and gear F2# are maintained as shown in FIG. 10(*c*) by the urging force applied by compressive spring FS. However, when gear F1# is driven in the direction indicated by Arrow KK, second convex parts F#1*c* and F2#*c* formed in convex part F1#*b* of gear F# and convex part F2#*b* on gear F2# are brought into mutual contact by a force opposing the urging force exerted by compressive spring FS, as shown in FIG. 10(*b*). Gear F2# is thereby driven to rotate in the direction indicated by Arrow KK.

With such a dual structure, gear F2# is engaged with gear H#, and therefore has a rotating load when image forming unit U1 is installed. When gear F1# is driven to rotate in the direction indicated by Arrow KK by the action of gear C2#, compressive spring FS will be compressed while gear F2# remains stopped, so that only gear F1# is rotated. Second convex part F1#*c* on gear F1# is brought into direct contact with second convex part F2#*c* on gear F2# in a brief period of time, as shown in FIG. 10(*b*) and gear F2# is driven rotate in the direction indicated by Arrow KK shown in FIG. 10(*b*), and gear H# is thereby driven.

When image forming unit U1 is removed upward as shown in FIG. 11, gear H#, with the rotational driving operation being stopped, as well as gear F2#, is released of the rotational driving load. Gear H# and gear F2# are disengaged without any excessive strain because gear H# and gear F2# are disposed in positions from which they can be detached from each other. Compressive spring FS expands, thereby rotating gear F2# in the direction indicated by Arrow KK as shown in FIG. 10(*c*) and restoring gear F2# to its original state.

When image forming unit U1 is installed downward from above as shown In FIG. 11 when the structure is in the condition shown in FIG. 10(*a*), gear H# rotates gear F2# in the direction reverse to its ordinary rotating direction, i.e., as shown in FIG. 10(*c*) in the counterclockwise direction (against Arrow KK), by a predetermined angle in counter-action to the expanding force of compressive spring FS. Thus, gear H# and gear F1# are engaged since gear H# has a driven rotational load generated by the relation of driving means 25 and so forth for driving endless coil spring 31 via gear V#. Second convex part F1#*c* and second convex part F2#*c* do not reach the state shown in FIG. 10(*b*) when gear F2# is rotated by the predetermined angle in the clockwise direction when image forming unit U1 is installed in its position.

When image forming unit U1 is installed in its position, it is possible that gear H# and gear F2# are first engaged, gear G# being subsequently engaged with gear F1#. In this case, the operations by the dual structure of gear C# should be performed after the operations by the dual structure of gear F# have been performed. The torque balance of the fourth driving system is determined by the urging forces furnished by compressive springs FS and CS, and has the dual construction of gears formed in series in gear C# and the gear F#. If the spring force of compressive spring FS is too large in comparison with the spring force of compressive spring CS, it is feared that the gap between second convex part C2#*c* and second convex part C2*c*, which must exist when gear G# is engaged with gear F1#, will not exist because gear C2# will have already rotated in the clockwise direction to contract compressive spring CS and gear F1# will have rotated in the counterclockwise direction along with the rotation of gear F2# in spite of the fact that gear G# has not yet engaged gear F1#, gears H# and F2# being set in their mutual engagement, as shown in FIG. 10(*c*).

Therefore, in a preferred embodiment the torque balance between gear C# and gear F# is set by setting the spring force of compressive spring CS greater than the spring force of compressive spring FS. Thus, the desired operation will be performed by the dual structure of the gear C# without being influenced by any action performed by the dual structure of gear F#. Even in a case in which gear H# and gear F1# are first engaged, gear G# and gear F1# being subsequently engaged, gear C2# would contract compressive spring CS, thereby rotating in the clockwise direction. Gear H# and gear F2# are then engaged, so that the gear F2# is rotated in the counterclockwise direction shown in FIG. 10(*c*). Thus, the apparatus will function properly.

In addition, the trouble described above will not occur when gear G# and gear F1# are engaged, gear H# and gear F2# being subsequently engaged, when image forming unit U1 is installed, since the gears will engage in the proper order.

Figure 13:
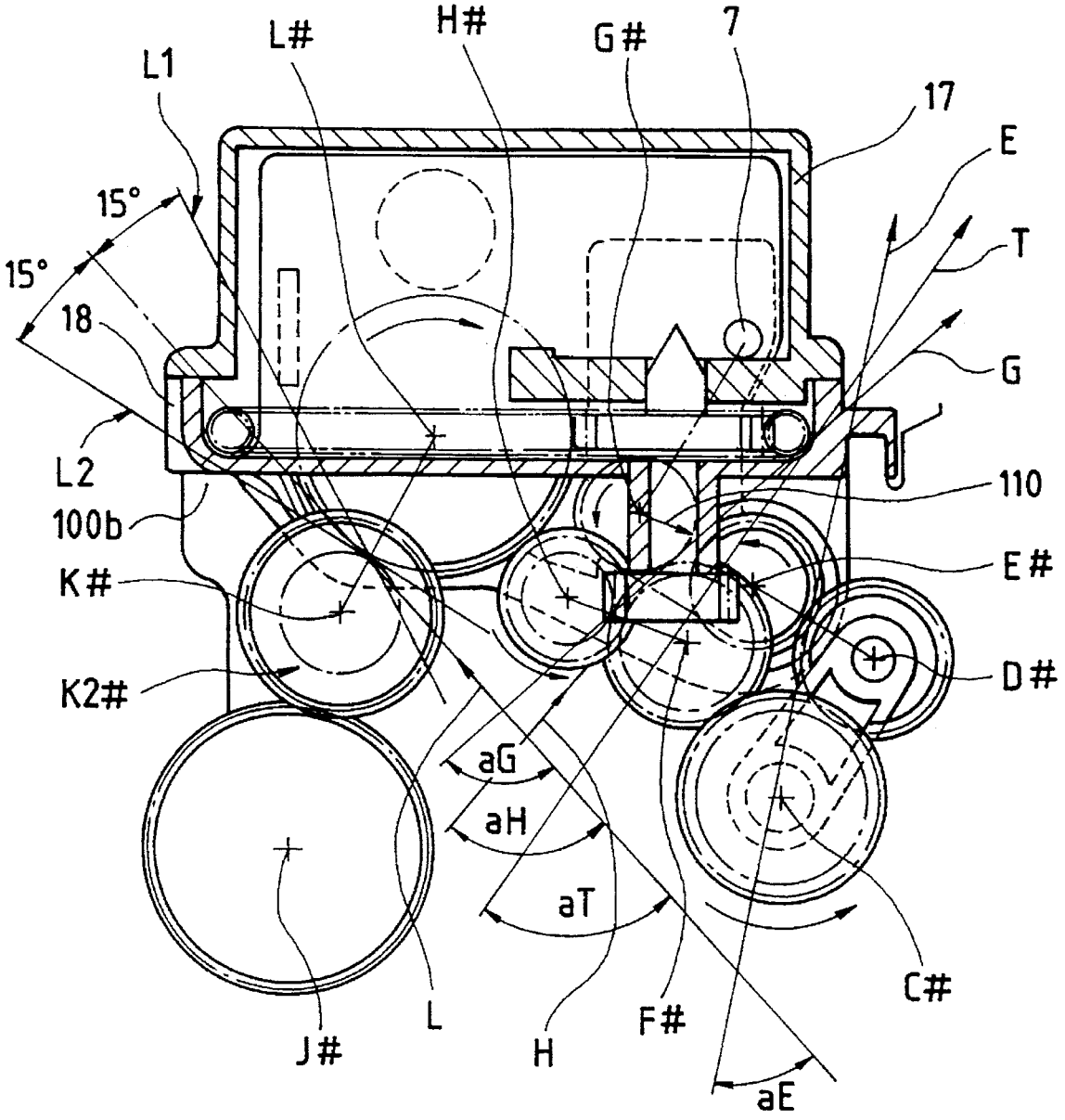
FIG. 13 is a partially sectioned side elevational view illustrating the driving operations for rotating the image forming unit UI of the preferred embodiment of the present invention.

Reference is now made to FIG. 13, wherein the relationship between driving force transmitting unit (driving unit U3), which is constructed with the above-mentioned driving gear train supported in a unit construction and fixed on third face 100*e* of the main frame 100, and the driven part at the side of the image forming unit U1 will now be described.

In this preferred embodiment, the driving unit at the side of the main unit and the driven part at the side of image forming unit U1 are constructed so that these parts disperse the driving force or the driven force from any single point. Thus, these parts will not need any highly rigid structure but can be formed of compact and low-priced structures.

The relationship between the driving unit at the side of the main unit and the driven parts at the side of image forming unit U1, as viewed in terms of the action of force, is indicated by the direction of the pressure angle of the gears at the respective points of engagement between the driving gears at the side of the main unit and the driven gears at the side of image forming unit U1, and are as described below for the individual driving systems.

<First Driving System>

The direction in which the force for driving gear L# works from gear F# is indicated by Arrow L moving diagonally upward to the left in FIG. 13.

<Second Driving System>

The direction in which the force for driving gear G# works from gear F# is indicated by Arrow G moving diagonally upward to the right in FIG. 13, and this direction is different by angle αG from the direction indicated by Arrow L in which the force for driving gear L# works from gear K2#. The specific angle αG in this preferred embodiment is approximately 95 degrees.

<Third Driving System>

The direction in which the force for driving gear E# works from gear D# is indicated by Arrow E moving diagonally upward to the right in FIG. 13, and this direction is different by angle mE from the direction indicated by Arrow L in which the force for driving gear L# works from gear K2# mentioned above. The specific angle αE in this preferred embodiment is approximately 55 degrees.

<Fourth Driving System>

The direction in which the force for driving gear H# works from gear F# is indicated by Arrow H moving diagonally upward to the right in FIG. 13, and this direction is different by the angle αH from the direction indicated by Arrow L in which the force for driving gear L# works from gear K2#. The specific angle αH in this preferred embodiment is approximately 85 degrees.

As described above, this preferred embodiment sets different working directions for the working of the rotational driving force for driving means 25 which drives developing roller 12, feeding roller 13 and endless coil spring 31, and provides the rotational driving force for driving agitator 23 in toner tank 20, as viewed in relation to the working direction indicated by arrow L for the force driving photosensitive drum 1 working from gear K2# mentioned above. Thus, the positions for the working of this force is scattered. Therefore, the driven part at the side of image forming unit U1 and the driving unit at the side of the main unit need not be formed as a highly rigid structure.

The description given above relates to the relations of the individual driving systems which are constructed with a view to avoiding the concentration of the driving force at the side of the main unit and the driven force at the side of image forming unit U1 on any single location in the apparatus. The individual driving forces as synthesized are found to work approximately in the diagonally upward direction indicated by Arrow T in FIG. 13, which is different by angle αT from the working direction indicated by Arrow L for the force which works from gear K2# for driving photosensitive drum 1. Since the working direction indicated by Arrow L and the working direction indicated by Arrow T do not combine forces in any linear series, it is possible to reduce the fixing force for the fixed installation of image forming unit U1.

Since image forming unit U1 may be attached and detached, the dispersion in the constructions of the individual component elements must be taken into account. A dispersion of plus or minus 15 degrees in the direction of the pressure angle of the gears at the point of engagement of the driving gear at the side of the main unit with the driven gear at the side of the image forming unit U1 is sufficient. In this preferred embodiment an apparatus is shown which surely displays the above-mentioned effect. Thus, the driving force which works at least approximately in the direction indicated by Arrow T works in a direction different than the direction between lines L1 and L2, which, being shown in FIG. 13, are different by plus and minus 15 degrees in relation to the working direction indicated by Arrow L for the force which works from gear K2# for driving photosensitive drum 1.

Next, the structural relationship of the driving force which works on developing roller 12 and feeding roller 13, which form the principal parts of developing unit 10 is described.

As mentioned above with reference to FIG. 4, FIG. 5, and FIG. 12, supporting members 5 and 5A, which rotatably support both the end portions of feeding roller 13 and developing roller 12, are strongly connected into a unified structure by fixing means such as screws by way of a connecting member 6. These members, along with regulating blade 14, are rotatably supported by supporting pin 7, as shown in FIG. 12, to rotate in relation to photosensitive drum 1 in one unit with supporting pin 7 as its pivot.

The principal parts of the developing unit mentioned above are urged to rotate in the direction indicated by Arrow 110 (FIG. 13) with supporting pin 7 as the center of their support (i.e., in the direction in which developing unit 10 moves away from photosensitive drum 1) by the effect of the driving force working in the direction indicated by Arrow G in the second driving system and the driving force working in the direction indicated by Arrow E in the third driving system, as shown in FIG. 13.

Accordingly, with the construction described above in this preferred embodiment, the apparatus achieves a stabilized nip width without developing any excessive driving force upon the occurrence of any intrusive phenomenon in the nip area where photosensitive drum 1 and developing roller 12 are in sliding contact. In addition, the positions for the driving operations of photosensitive drum 1 and developing unit 10 are dispersed, so that no concentration of the load occurs on any single point either at the driven part at the side of image forming unit U1 or at the driving unit at the side of the main unit. It is therefore possible to perform a driving operation with few rotational jitters, vibrations, or rattling noises even if the driven part at the side of image forming unit U1 or the driving unit at the side of the main unit is not necessarily formed of any highly rigid construction.

The principal parts of developing unit 10 are urged to rotate in the direction indicated by arrow 110, rotating on supporting pin 7 as the center of their support, i.e., in the direction away from photosensitive drum 1. Since supporting members 5 and 5A are provided with springs 8 and 8A, which furnish their tensile force to supporting members 5 and 5A so as to urge developing roller 12 in the direction toward photosensitive drum 1, it is possible for this construction to form a stable nip area between developing roller 12 and photosensitive drum 1.

As described above, this preferred embodiment produces the following actions and effect:

(i) The structure for mounting gears or the like as rotary members as described in this preferred embodiment is formed as a burring part or a projecting part respectively in a position where first wheel train mounting unit 101 and second wheel train mounting unit 102, which are sheet metal members disposed in mutually opposite positions, are in confrontation with each other. The shaft portions or the hole portions on both ends of a gear (simple or complex (e.g., C# and F#)) or the like which is disposed between a pair of sheet metal members are rotatably supported by the burring part or the projecting part mentioned above so that the gear or the like has the shaft portions at both the ends thereof supported with the burring part, or has the hole parts on both the ends thereof supported with the projecting part, or has the shaft portion at one end thereof supported with the burring part and has the hole part at the other end thereof supported with the projecting part.

The construction formed as described can rotatably mount a part or the like by supporting the part between a pair of sheet metal members with burring parts or projecting parts formed thereon, so that the construction according to the present invention does not require any supporting shaft, any planting or fixing work, thereof, any work for inserting a shaft into a shaft bearing, or any work for bending the top end part of the burring part that would be necessary for the prior art described above.

Thus, the image forming apparatus which employs such a construction as described above in this preferred embodiment has a reduced size and a lower cost while additionally achieving high stability in its operation.

Further, the supporting parts for the rotary members are formed in a structure with burring processing or projecting processing done directly on the sheet metal members. Specifically, the projecting parts and burring parts may be formed by deforming a sheet by deforming and/or cutting a sheet of metal and may be formed at the time that the wheel train mounting unit is cut from a larger sheet of metal and/or bent where desired. Since the supporting parts are constructed in such a manner as to support the rotary member at both of its sides, the supporting parts have improved strength, therefore enduring greater axial force (motive force), in comparison with the structure with a supporting shaft planted in the frame.

(ii) The projecting part formed on the sheet metal member (for example, projecting part 102*a* shown in FIG. 10(*a*)) has a top end portion formed in a round contour, so that it is easier to insert the projecting part into a hole made in an end portion of a rotary member (for example, hole F1#d shown in FIG. 10(*a*)). This feature eases assembly and also prevents the rotary member (for example, gear F1# in FIG. 10(*a*)) from being damaged.

(iii) Since the inside surface of the burring part and the outside surface of the projecting part are polished to a mirror-smooth finish, the rotational sliding of the rotary member is thereby improved. This improvement attains a reduction in the torque loss to friction and an improvement in the durability of the parts. Specifically, if the rotating members are made of resin, sufficient durability can be attained without applying oil thereto.

(iv) Driving unit U3 comprises a pair of sheet metal members, i.e., first wheel train mounting unit 101 and second wheel train mounting unit 102 fixed on main frame 100. As a result of this arrangement, the first wheel train mounting unit and the second wheel train mounting unit form a part of the frame. It is therefore possible to achieve a further reduction of the size of the apparatus and a further reduction off its cost in that there is no need for separate frame members and support members.

(v) The positional accuracy between image forming unit U1, which is provided with photosensitive drum 1, and exposing unit U2, which forms and exposes a latent image on photosensitive drum 1, is important for improving the quality of the image produced by the image forming unit U1. Also, the positional accuracy between photosensitive drum 1 and driving unit U1, which rotates photosensitive drum 1, is important for rotating photosensitive drum 1 smoothly without vibrations, thereby achieving a reduction of any irregular revolutions of photosensitive drum 1 and improving the quality of the produced image.

With the image forming apparatus described in this preferred embodiment, one part of the frame on which the image forming unit U1 and the exposing unit U2 are mounted is formed of the pair of sheet metal members, i.e., first wheel train mounting unit 101 and second wheel train mounting unit 102, in driving unit U3. In addition, at least one of the positioning parts for the image forming unit U1, i.e., 101*g* (see FIG. 3), is provided in driving unit U3. The positioning accuracy among these three units can therefore be maintained at a high degree of accuracy since they are coupled with the same sheet metal members, so that it is possible for the apparatus to produce high-quality images.

Specifically, with the image forming apparatus described in this preferred embodiment, it is possible to achieve a further reduction in size and a further reduction in cost while making it possible to produce images of higher quality.

(vi) The frame which includes the sheet metal member of driving unit U3 forms a means for shielding the electromagnetic noises generated in the inside area of the apparatus. This structure therefore achieves a further reduction in the size of the apparatus and a reduction in its cost.

In the preferred embodiment described above, a train of several types of freely rotatable driving gears are supported within a pair of sheet metal members, i.e., first wheel train mounting unit 101 and second wheel train mounting unit 102. These driving gears receive a supporting load in the radial direction from a freely rotatable shaft portion if they are engaged with the burring part or from the supporting portion of a freely rotatable hole part if they are engaged with the projecting part, in correspondence with their respective parts in furnishing the driving force. In order to deal properly with the supporting load, it will be satisfactory to set the axial direction height of the above-mentioned burring part or the above-mentioned projecting part in an appropriate amount corresponding to the load. For example, it is desirable to set a height which corresponds to two times or more of the plate thickness (i.e., approximately 2 to 10 mm for a plate thickness of 1 mm). Deviations will occur in the course of mass production in the positions of the burring parts or the projecting parts. In order to provide a stable support for the gears by canceling such relative deviations in the positions, it will be effective to set a low height for the axial direction height of the above-mentioned burring part or the above-mentioned projecting part. Therefore, it is recommended that the axial direction height of the part be selected at a height in fair balance with the supporting load and yet be advantageous for this production.

In the description of the illustrated construction of the driving force transmitting unit, a gear which is supported so as to rotate freely has been taken as an example. However, the advantages of the present invention will be apparent even if the rotary member is a sprocket wheel driven with a chain or a pulley or the like driven with a belt, which is used in place of the gear.

Figure 14:
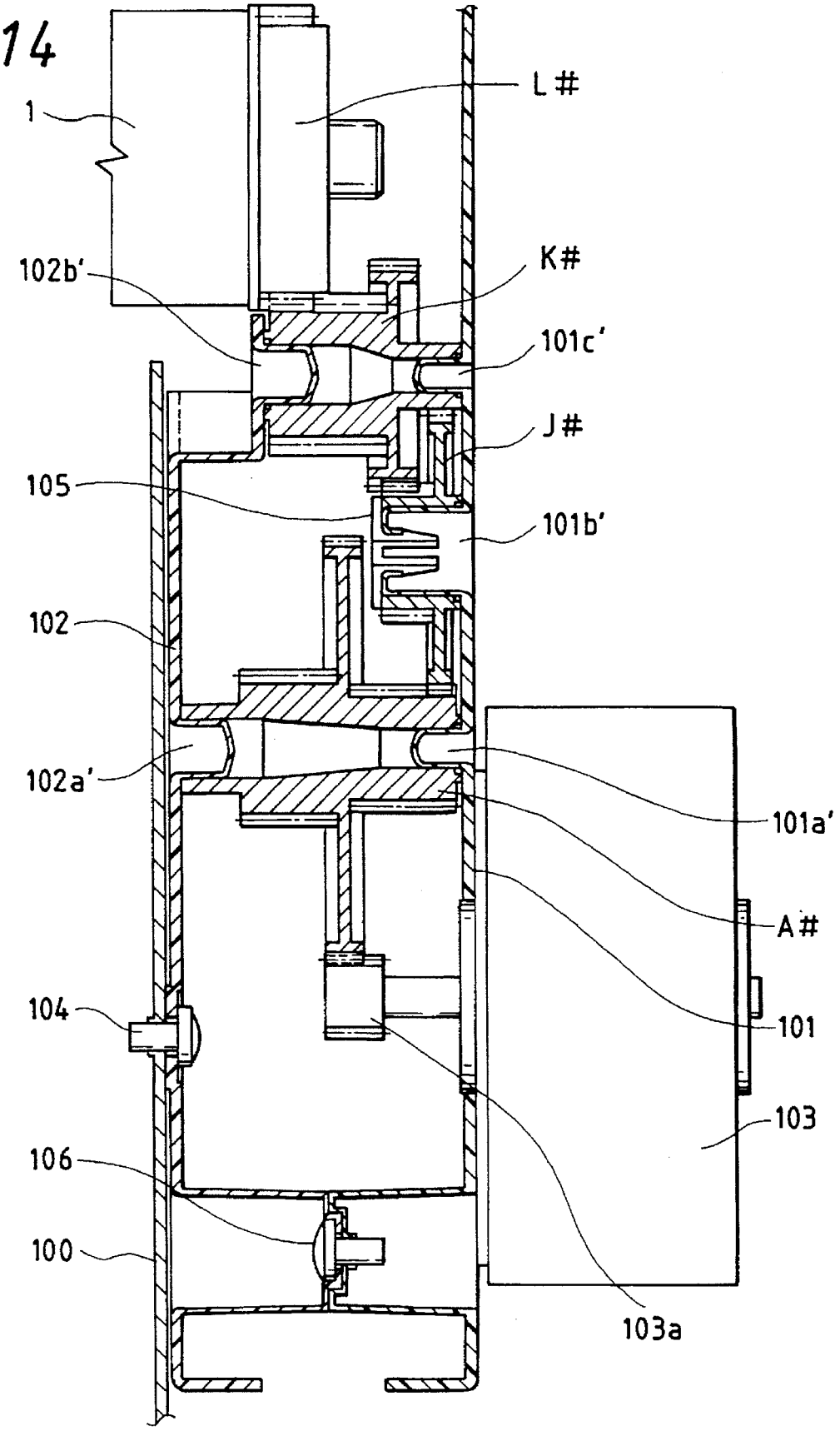
FIG. 14 is an elevational cross-sectional view of a modified structure of another embodiment of a portion of the rotational force transmitting unit of the present invention taken along a line between the axes of rotation of the gears in question.
Figure 15:
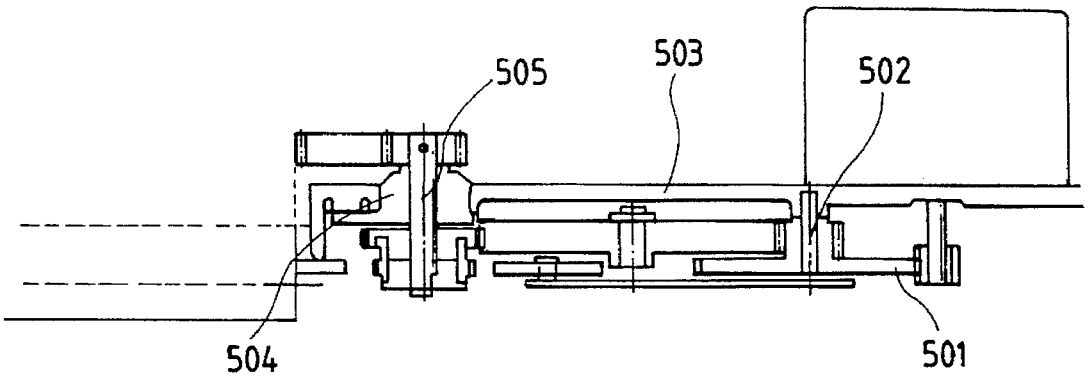
FIG. 15 PRIOR ART
FIG. 15 is a fragmentary side elevational view illustrating a structure for mounting a rotary member according to the prior art at an intermediate stage of production.
Figure 16:
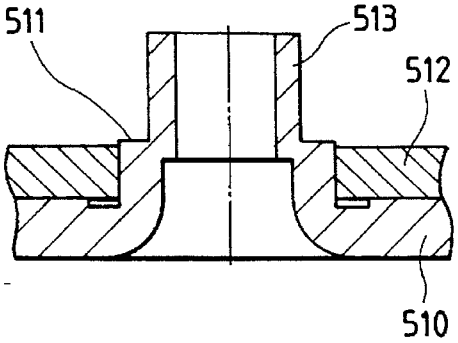
FIG. 16 PRIOR ART
FIG. 16 is a cross-sectional view illustrating a structure for mounting a rotary member according to the prior art at an intermediate stage of production.
Figure 18:
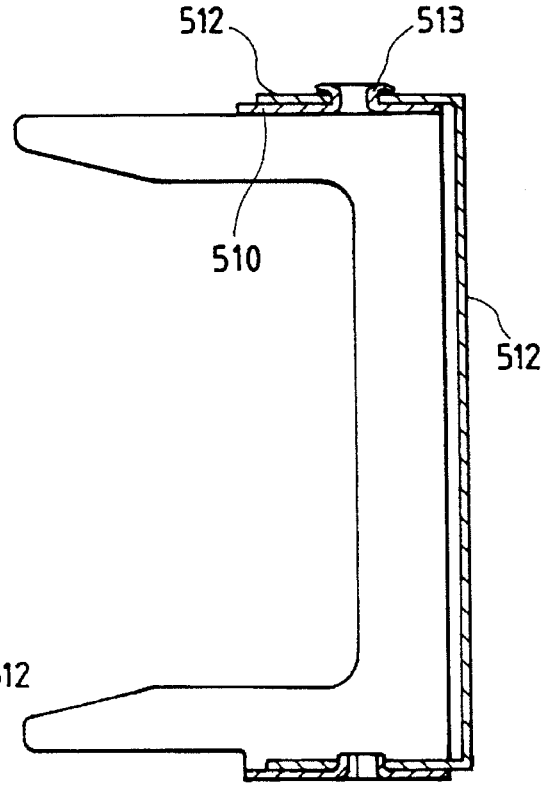
FIG. 18 PRIOR ART
FIG. 18 is a top plan view illustrating a structure for mounting a rotary member according to the prior art.
Figure 17:
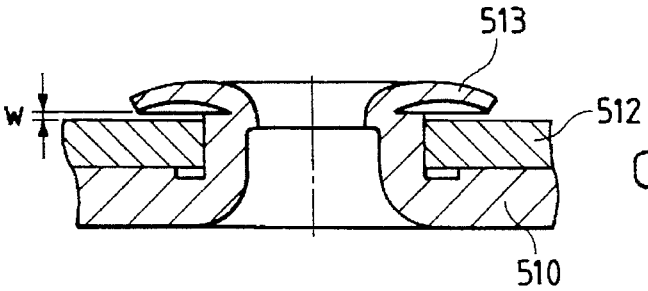
FIG. 17 PRIOR ART
FIG. 17 is a cross-sectional view illustrating a structure for mounting a rotary member according to the prior art of FIG. 16 after completion.

FIG. 14 shows an alternative embodiment of the present invention for the structure of the driving unit in an image forming apparatus. In FIG. 14, like parts are given like reference numerals. In certain situations, it will be more desirable to form the structure for mounting the rotary member in the construction shown in FIG. 14.

A characteristic feature of this example of the alternative embodiment is that the supporting parts which support a rotary member are formed as projecting parts with their end portions formed in a round contour.

In accordance with FIG. 14, all the supporting parts which support gear A# and gear K# at both ends are composed of the projecting parts 101*a*', 101*b*' and 101*c*', each formed with its end portion as a round contour.

With such a mounting structure, it is extremely easy to perform assembly work. It is possible to assemble the structure for mounting a rotary member simply by setting first wheel train mounting unit 101 so that the plurality of projecting parts 102*a*' and 102*b*' point upward. Next gear A# and gear K# are set onto each of the projecting parts. Finally, second wheel train mounting unit 102 is set over gear A# and gear K#, and the assembled mounting structure is fixed with an appropriate means such as screws 106. With this procedure, it is necessary either to assemble in advance or to assemble subsequently those component parts which are not supported at both the ends by first and second wheel train mounting units 101 and 102.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A structure for mounting a rotary member, comprising:

at least two sheet members disposed in spaced opposition to each other;

a first support structure formed in one of said sheet members;

a second support structure formed in the other of said sheet members and facing said first support structure, each of said first and second support structures being one of a burring part and a projecting part; and a rotary member formed with one an axial shaft or an axial bore on each side thereof, said rotary member being positioned between said sheet members and rotatably supported by said first and second support structures.

2. The structure of claim 1, wherein said sheet members are sheet metal members.

3. The structure of claim 2, wherein said burring parts and projection parts are formed integrally with said sheet metal members by deformation thereof.

4. The structure of claim 1, wherein the end portion of each of said projecting parts is formed as a substantially round contour.

5. The structure of claim 1, wherein the outer surface of each of said projecting parts is formed with a mirror-smooth finish.

6. The structure of claim 2, wherein the inside surface of each of said burring parts is formed with a mirror-smooth finish.

7. The structure of claim 1, including a plurality of said first and second opposed support structures formed in said opposed sheet members, and a plurality of said rotary members each supported by one of said first and second opposed support structures.

8. The structure of claim 7, wherein all of said first supporting structures are projecting parts.

9. The structure of claim 8, wherein the end portion of each of said projecting parts is formed as a substantially round contour.

10. The structure of claim 1, wherein each of said rotating members is formed integral with said axial bore and/or axial shaft.

11. The structure of claim 1, further comprising:

a driving motor;

a driving force transmitting unit which transmits the motive power of said driving motor; and a driven member rotated by said driving force transmitting unit, at least one of said driving force transmitting unit or said driven member including said rotary member supported between said sheet members by said supporting structures.

12. The structure of claim 11, including a plurality of said first and second opposed support structures formed in said opposed sheet members, and a plurality of said rotary members each supported by one of said first and second opposed support structures.

13. The structure of claim 12, wherein said sheet members are sheet metal members.

14. The structure of claim 12, wherein said burring parts and projection parts are formed integrally with said sheet metal members by deformation thereof.

15. The structure of claim 12, wherein the end portion of each of said projecting parts is formed as a substantially round contour.

16. The structure of claim 12, wherein the outer surface of each of said projecting parts is formed with a mirror-smooth finish.

17. The structure of claim 12, wherein the inside surface of each of said burring parts is formed with a mirror-smooth finish.

18. The structure of claim 12, wherein each of said rotating members is formed integral with said axial bore and/or axial shaft.

19. A method of mounting a plurality of rotary parts, comprising the steps of:

providing a first sheet member formed with a plurality of spaced projecting parts on one side thereof;

supporting said first sheet member on the side thereof opposed to said projecting parts so that said projecting parts face upwardly;

providing a plurality of rotating members each formed with an axial base on one side thereof for coupling with a projecting part formed on said first sheet member and one of an axial bore or an axial shaft on the other side of said rotating member;

mounting a rotating member on each projecting part by its axial base;

providing a second sheet member formed with a projecting part or a burring part positioned to oppose each projecting part of said first sheet member and selected to couple with the axial bore or axial shaft, respectively, on the other side of said rotary member; and mounting said second sheet member on the mounted rotary members and so securing said sheet members together.

20. The method of claim 19, wherein said first and second sheet members are formed from metal with burring parts and projecting parts formed integrally therein by deformation of said sheet members.

21. The method of claim 20, wherein the end portion of each of said projecting parts are formed as substantially round contours.

22. An image forming apparatus, comprising:

a frame;

an image forming unit mounted on said frame and having a rotatably supported photosensitive drum;

an exposing unit mounted on said frame for forming a latent image on said photosensitive drum by exposing said photosensitive drum to light; and a driving unit for rotatably driving said photosensitive drum, further comprising:

at least two sheet members disposed in spaced opposition to each other;

a first support structure formed in one of said sheet members;

a second support structure formed in the other of said sheet members and facing said first support structure, each of said first and second support structures being one of a burring part and a projecting part; and a rotary member formed with one an axial shaft or an axial bore on each side thereof, said rotary member being positioned between said sheet members and rotatably supported by said first and second support structures;

one of said first and second sheet members forming a part of said frame and engaging said image forming unit to at least in part position said image forming unit.

23. The structure of claim 22, wherein said sheet members are sheet metal members.

24. The structure of claim 22, wherein said burring parts and projection parts are formed integrally with said sheet metal members by deformation thereof.

25. The structure of claim 22, wherein the end portion of each of said projecting parts is formed as a substantially round contour.

26. The structure of claim 22, wherein the outer surface of each of said projecting parts is formed with a mirror-smooth finish.

27. The structure of claim 22, wherein the inside surface of each of said burring parts is formed with a mirror-smooth finish.

28. The structure of claim 22, including a plurality of said first and second opposed support structures formed in said opposed sheet members, and a plurality of said rotary members each supported by one of said first and second opposed support structures.

29. The structure of claim 22, wherein each of said rotating members is formed integral with said axial bore and/or axial shaft.

30. The structure of claim 28, wherein said first and second sheet members are formed of metal with said burring parts and projecting parts formed integral with said metal sheet members by deformation thereof.

31. The image forming apparatus of claim 23, and including means for generating electromagnetic radiation inside said image forming apparatus, said frame and said sheet members forming shielding for shielding said electromagnetic radiation generated inside said image forming apparatus.

32. A gear engaging and driving structure, comprising:

a pair of spaced supports;

a driving member;

a driven member, said driving and driven members being coaxially rotatably mounted between said spaced supports and each including an interconnecting region lying at least in part in the same radially extended plane, the respective interconnecting portions of each of said driving and driven members each including at least one radially extending projection shaped to define a cavity therebetween; and a spring included within said cavity between said projections biasing said projections circumferentially apart, the interconnecting region of one of said driven and driving members being formed with at least one pair of first circumferentially spaced stop portions having the projection of the other of said driven and driving members therebetween, said spring biasing said projections apart until the projection of said other of said driven and driving members is engaged against a first of said first stop portions when said driving member is not externally driven, when said driving member is externally driven said projections being brought closer together against the bias force of said spring until the second of said first stop portions is engaged against the projection of said other of said driven and said driving members to permit said driving member to rotate said driven member.

33. The structure of claim 32, wherein the interconnecting portions of said one of said driving and driven members includes a second radially extending projection, the interconnecting region of said one of said driven and driving members is formed with said pair of second circumferentially spaced stop portions having said second projection of said one of said driven and driving members therebetween, when said driving member is not externally driven said spring biasing the second projection of said one of said driven and driving members into engagement with a first of said second stop portions when said driving member is externally driven, and said projections are brought closer together, the second of said second stop portions is engaged by said second projection of said one of said driven and driving members.

34. The structure of claim 32, wherein at least one of said driving and driven members includes a peripheral gear portion.

35. The structure of claim 34, and including a second of said driving members, a second of said driven members and a second spring in the cavity defined by the projections of said second driving member and said second driven member, said second driving member and second driven member being coaxially mounted between said supports, at least one of said second driving member and second driven member having a second peripheral gear portion in nesting engagement with said peripheral gear portion of one of said first-mentioned driving member and first-mentioned driven member, the spring force of one of said first-mentioned and second-mentioned spring members being greater than the spring force of the other.

36. An image forming apparatus, comprising:

a force transmitting member producing a rotary driving force;

a photosensitive drum;

a developing roller;

a feeding roller;

a frame structure rotatably supporting said photosensitive drum, developing roller and feeding roller and supporting said force transmitting member;

a plurality of gears operatively coupling said force transmitting member and said photosensitive drum, developing roller and feeding roller, said gears being positioned relative to each other so that the direction of force on the gear mounted to the photosensitive drum is angularly spaced from the directions of force on the respective gears operatively mounted to the developing roller and feeding roller, the direction of force on a gear being the direction of the pressure angle of a driving gear on a driven gear, whereby said forces are dispersed.

37. The apparatus of claim 36, wherein the directions of force on the gears mounted to each of said developing roller, feeding roller and agitator and spring driving rotary member are angularly spaced from each other by an angle less than their respective angular spacing from the gear mounted on the force transmitting member.

38. The apparatus of claim 37, wherein the direction of force on the gear mounted on said agitator and spring driving rotary member is disposed at an angle of approximately 85°±15° from the direction of force on its gear mounted on said photosensitive drum.

39. The apparatus of claim 36, wherein the direction of force on the gear mounted on the developing roller is disposed at an angle of approximately 95°±15° from the direction of force on the gear mounted on the photosensitive drum.

40. The apparatus of claim 36, wherein the direction of force on the gear mounted on the feeding roller is disposed at an angle of approximately 55°±15° from the direction of force on the gear mounted on said photosensitive drum.

41. The apparatus of claim 36, wherein the directions of force on the gears mounted on said developing roller and said feeding roller are angularly spaced by a substantially smaller angle than the respective angular spacing of the directions of force on the gears mounted on each of the developing roller and feeding roller from the direction of force on the gear mounted on the photosensitive drum.

42. The apparatus of claim 36, and including an agitator and spring driving rotary member operatively coupled by said gears to said force transmitting member, the direction of force on the gear mounted to said agitator and spring driving rotary member is angularly spaced from the direction of force on the gear mounted on said force transmitting member.

* * * * *